US009022104B2

(12) United States Patent
Springett et al.

(10) Patent No.: US 9,022,104 B2
(45) **Date of Patent: *May 5, 2015**

(54) BLOWOUT PREVENTER BLADE ASSEMBLY AND METHOD OF USING SAME

(75) Inventors: Frank Benjamin Springett, Spring, TX (US); Christopher Dale Johnson, Cypress, TX (US); Shern Eugene Peters, Houston, TX (US); Eric Trevor Ensley, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 770 days.

This patent is subject to a terminal disclaimer.

(21) Appl. No.: 13/247,465

(22) Filed: Sep. 28, 2011

(65) Prior Publication Data

US 2012/0073815 A1 Mar. 29, 2012

Related U.S. Application Data

(60) Provisional application No. 61/387,805, filed on Sep. 29, 2010.

(51) Int. Cl.
*E21B 33/06* (2006.01)

(52) U.S. Cl.
CPC ..... *E21B 33/063* (2013.01); *E21B 33/062* (2013.01)

(58) Field of Classification Search
CPC ..... E21B 43/062; E21B 43/063
USPC ..... 166/298, 55, 85.4; 251/1.3
See application file for complete search history.

(56) References Cited

U.S. PATENT DOCUMENTS

| | | | | |
|---|---|---|---|---|
| 2,178,698 | A | 11/1939 | Penick et al. | |
| 2,231,613 | A | 2/1941 | Burke | |
| 2,304,793 | A | 12/1942 | Bodine, Jr. | |
| 2,592,197 | A | 4/1952 | Schweitzer | |
| 2,752,119 | A | 6/1956 | Allen et al. | |
| 3,040,611 | A | 6/1962 | Tournaire | |
| 3,272,222 | A | 9/1966 | Allen et al. | |
| 3,379,255 | A * | 4/1968 | Burns, Jr. et al. | 166/55 |
| 3,399,728 | A | 9/1968 | Taylor | |
| 3,554,278 | A | 1/1971 | Reistle, III et al. | |
| 3,554,480 | A | 1/1971 | Rowe | |

(Continued)

FOREIGN PATENT DOCUMENTS

| | | |
|---|---|---|
| WO | 2006058244 | 6/2006 |
| WO | 2007024372 | 3/2007 |

OTHER PUBLICATIONS

US 5,778,918, 7/1998, McLelland (withdrawn).

(Continued)

*Primary Examiner* — Giovanna Wright
(74) *Attorney, Agent, or Firm* — JL Salazar Law Firm

(57) ABSTRACT

Techniques for shearing a tubular of a wellbore penetrating a subterranean formation with a blowout preventer are provided. The blowout preventer has a housing with a hole therethrough for receiving the tubular. The techniques relate to a blade assembly including a ram block movable between a non-engagement position and an engagement position about the tubular, a blade carried by the ram block for cuttingly engaging the tubular, and a retractable guide carried by the ram block and slidably movable therealong. The restractable guide has a guide surface for urging the tubular into a desired location in the blowout preventer as the ram block moves to the engagement position.

15 Claims, 25 Drawing Sheets

(56) References Cited

U.S. PATENT DOCUMENTS 3,561,526 A 2/1971 Williams et al.
3,647,174 A 3/1972 LeRouax
3,670,761 A 6/1972 LeRouax
3,716,068 A 2/1973 Addison
3,741,296 A 6/1973 Murman et al.
3,744,749 A 7/1973 LeRouax
3,766,979 A 10/1973 Petrick
3,863,667 A 2/1975 Ward
3,918,478 A 11/1975 LeRouax
3,922,780 A 12/1975 Green
3,946,806 A 3/1976 Meynier, III
3,955,622 A 5/1976 Jones
4,007,797 A 2/1977 Jeter
4,043,389 A 8/1977 Cobb
4,057,887 A 11/1977 Jones et al.
4,119,115 A 10/1978 Carruthers et al.
4,132,265 A 1/1979 Williams, Jr.
4,132,267 A * 1/1979 Jones ..... 166/55
4,140,041 A 2/1979 Frelau
4,215,749 A 8/1980 Dare et al.
4,220,206 A 9/1980 Van Winkle
4,253,638 A 3/1981 Troxell, Jr.
4,313,496 A 2/1982 Childs et al.
4,341,264 A 7/1982 Cox et al.
4,347,898 A 9/1982 Jones
4,372,527 A 2/1983 Rozenbauch et al.
4,392,633 A 7/1983 Van Winkle
4,416,441 A 11/1983 Van Winkle
4,437,643 A 3/1984 Brakhage, Jr. et al.
4,492,359 A 1/1985 Baugh
4,504,037 A 3/1985 Beam et al.
4,508,313 A 4/1985 Jones
4,516,598 A 5/1985 Stupak
4,518,144 A 5/1985 Vicic et al.
4,519,577 A 5/1985 Jones
4,523,639 A 6/1985 Howard
4,526,339 A 7/1985 Miller
4,537,250 A 8/1985 Troxell, Jr.
4,540,046 A 9/1985 Granger et al.
4,550,895 A 11/1985 Shaffer
4,558,842 A 12/1985 Peil et al.
4,612,983 A 9/1986 Karr, Jr.
4,646,825 A 3/1987 Van Winkle
4,647,002 A 3/1987 Cruchfield
4,690,033 A 9/1987 Van Winkle
4,690,411 A 9/1987 Van Winkle
4,699,350 A 10/1987 Herve
4,923,005 A 5/1990 Laky et al.
4,923,008 A 5/1990 Wachowicz et al.
4,943,031 A 7/1990 Van Winkle
4,969,390 A 11/1990 Williams, III
5,002,130 A 3/1991 Laky et al.
5,013,005 A 5/1991 Nance
5,025,708 A 6/1991 Smith et al.
5,056,418 A 10/1991 Granger et al.
5,178,215 A 1/1993 Yenulis et al.
5,199,493 A 4/1993 Sodder, Jr.
5,217,073 A 6/1993 Bruns
5,237,899 A 8/1993 Schartinger
5,360,061 A 11/1994 Womble
5,361,832 A 11/1994 Van Winkle
5,400,857 A 3/1995 Whitby et al.
5,505,426 A 4/1996 Whitby et al.
5,515,916 A 5/1996 Haley
5,566,753 A 10/1996 VanWinkle
5,575,451 A 11/1996 Colvin et al.
5,575,452 A 11/1996 Whitby et al.
5,588,491 A 12/1996 Brugman et al.
5,590,867 A 1/1997 Van Winkle
5,655,745 A 8/1997 Morill
5,662,171 A 9/1997 Brugman et al.
5,735,502 A 4/1998 Levett et al.
5,863,022 A 1/1999 Van Winkle
5,897,094 A 4/1999 Brugman et al.
5,918,851 A 7/1999 Whitby
5,961,094 A 10/1999 Van Winkle
5,975,484 A 11/1999 Brugman et al.
6,006,647 A 12/1999 Van Winkle
6,012,528 A 1/2000 Van Winkle
6,016,880 A 1/2000 Hall et al.
6,113,061 A 9/2000 Van Winkle
6,158,505 A 12/2000 Araujo
6,164,619 A 12/2000 Van Winkle et al.
6,173,770 B1 1/2001 Morill
6,192,680 B1 2/2001 Brugman et al.
6,244,336 B1 6/2001 Kachich
6,276,450 B1 8/2001 Seneviratne
6,374,925 B1 4/2002 Elkins et al.
6,484,808 B2 11/2002 Jones et al.
6,510,897 B2 1/2003 Hemphill
6,530,432 B2 3/2003 Gipson
6,601,650 B2 8/2003 Sundararajan
6,718,860 B2 4/2004 Mitsukawa et al.
6,719,042 B2 4/2004 Johnson et al.
6,742,597 B2 6/2004 Van Winkle et al.
6,834,721 B2 12/2004 Suro
6,843,463 B1 1/2005 McWhorter et al.
6,857,634 B2 2/2005 Araujo
6,964,303 B2 11/2005 Mazorow et al.
6,969,042 B2 11/2005 Gaydos
6,974,135 B2 12/2005 Melancon et al.
7,011,159 B2 3/2006 Holland
7,011,160 B2 3/2006 Boyd
7,044,430 B2 5/2006 Brugman et al.
7,051,989 B2 5/2006 Springett et al.
7,051,990 B2 5/2006 Springett et al.
7,055,594 B1 6/2006 Springett et al.
7,086,467 B2 8/2006 Schlegelmilch et al.
7,108,081 B2 9/2006 Boyadjieff
7,165,619 B2 1/2007 Fox et al.
7,181,808 B1 2/2007 Van Winkle
7,195,224 B2 3/2007 Le
7,207,382 B2 4/2007 Schaeper
7,225,873 B2 6/2007 Schlegelmilch et al.
7,234,530 B2 6/2007 Gass
7,243,713 B2 7/2007 Isaacks et al.
7,270,190 B2 9/2007 McWhorter et al.
7,287,544 B2 10/2007 Seneviratne et al.
7,331,562 B2 2/2008 Springett
7,350,587 B2 4/2008 Springett et al.
7,354,026 B2 4/2008 Urrutia
7,360,603 B2 4/2008 Springett et al.
7,367,396 B2 5/2008 Springett et al.
7,389,817 B2 6/2008 Almdahl et al.
7,410,003 B2 8/2008 Ravensbergen
7,434,369 B2 10/2008 Uneyama et al.
7,464,765 B2 12/2008 Isaacks et al.
7,487,848 B2 2/2009 Wells et al.
7,520,129 B2 4/2009 Springett
7,523,644 B2 4/2009 Van Winkle
7,673,674 B2 3/2010 Lam
7,703,739 B2 4/2010 Judge et al.
7,726,418 B2 6/2010 Ayling
7,748,473 B2 7/2010 Wells et al.
7,798,466 B2 9/2010 Springett et al.
7,814,979 B2 10/2010 Springett et al.
7,926,501 B2 4/2011 Springett et al.
2004/0124380 A1 7/2004 Van Winkle
2006/0076526 A1 4/2006 McWhorter et al.
2007/0137866 A1 6/2007 Ravensbergen et al.
2008/0040070 A1 2/2008 McClanahan
2008/0189954 A1 8/2008 Lin
2008/0267786 A1 10/2008 Springett et al.
2009/0056132 A1 3/2009 Foote
2009/0205838 A1 8/2009 Springett
2010/0038088 A1 2/2010 Springett et al.
2012/0073816 A1* 3/2012 Springett et al. ..... 166/298

OTHER PUBLICATIONS

International Preliminary Report on Patentability for PCT Patent Application No. PCT/GB2011/051852 dated Apr. 2, 2013, 6 pages.
International Search Report for PCT Application No. PCT/GB2011/051852 dated Jan. 22, 2013 (4 pages).

(56) References Cited

OTHER PUBLICATIONS

Examination Report for European Patent Application No. EP11770145.8 dated Jul. 30, 2013, 4 pages.
Response to Examination Report for European Patent Application No. EP11770145.8 dated Oct. 9, 2013, 7 pages.
Canadian Office Action for Patent Application No. 2,812,646 dated Jun. 25, 2014, 2 pages.
Canadian Office Action for Patent Application No. 2,812,648 dated Jul. 24, 2014, 2 pages.
Preliminary Rejection and Translation for Korean Patent Application No. 10-2013-7010718 dated Aug. 19, 2014, 6 pages.
Preliminary Rejection and Translation for Korean Patent Application No. 10-2013-7010720 dated Aug. 20, 2014, 6 pages.
Examination Report for European Patent Application No. 117701475.8 dated Aug. 21, 2014, 1 page.

* cited by examiner

BLOWOUT PREVENTER BLADE ASSEMBLY AND METHOD OF USING SAME

CROSS-REFERENCE TO RELATED APPLICATION

This application claims the benefit of U.S. Provisional Application No. 61/387,805, filed Sep. 29, 2010, the entire contents of which are hereby incorporated by reference.

BACKGROUND

1. Field

The present invention relates generally to techniques for performing wellsite operations. More specifically, the present invention relates to techniques, such as a tubular centering device and/or a blowout preventer (BOP).

2. Description of Related Art

Oilfield operations are typically performed to locate and gather valuable downhole fluids. Oil rigs may be positioned at wellsites and downhole tools, such as drilling tools, may be deployed into the ground to reach subsurface reservoirs. Once the downhole tools form a wellbore to reach a desired reservoir, casings may be cemented into place within the wellbore, and the wellbore completed to initiate production of fluids from the reservoir. Tubulars or tubular strings may be positioned in the wellbore to enable the passage of subsurface fluids from the reservoir to the surface.

Leakage of subsurface fluids may pose an environmental threat if released from the wellbore. Equipment, such as BOPs, may be positioned about the wellbore to form a seal about a tubular therein, for example, to prevent leakage of fluid as it is brought to the surface. BOPs may have selectively actuatable rams or ram bonnets, such as tubular rams (to contact, engage, and/or encompass tubulars to seal the wellbore) or shear rams (to contact and physically shear a tubular), that may be activated to sever and/or seal a tubular in a wellbore. Some examples of ram BOPs and/or ram blocks are provided in U.S. Pat. Nos. 3,554,278; 4,647,002; 5,025,708; 7,051,989; 5,575,452; 6,374,925; 7,798,466; 5,735,502; 5,897,094 and 2009/0056132. Techniques have also been provided for cutting tubing in a BOP as disclosed, for example, in U.S. Pat. Nos. 3,946,806; 4,043,389; 4,313,496; 4,132,267; 2,752,119; 3,272,222; 3,744,749; 4,523,639; 5,056,418; 5,918,851; 5,360,061; 4,923,005; 4,537,250; 5,515,916; 6,173,770; 3,863,667; 6,158,505; 4,057,887; 5,505,426; 3,955,622; 7,234,530 and 5,013,005. Some BOPs may be provided guides as described, for example, in U.S. Pat. Nos. 5,400,857, 7,243,713 and 7,464,765.

Despite the development of techniques for cutting tubulars, there remains a need to provide advanced techniques for more effectively sealing and/or severing tubulars. The present invention is directed to fulfilling this need in the art.

SUMMARY

Disclosed herein is a method and apparatus for centering a tubular in a blowout preventer. In at least one aspect, the disclosure relates to a blade assembly of a blowout preventer for shearing a tubular of a wellbore penetrating a subterranean formation. The blowout preventer includes a housing with a hole therethrough for receiving the tubular. The blade assembly includes a ram block which is movable between a non-engagement position and an engagement position about the tubular. The blade assembly also includes a blade carried by the ram block for cuttingly engaging the tubular. The blade assembly also includes a retractable guide carried by the ram block and slidably movable therealong. The retractable guide has a guide surface for urging the tubular into a desired location in the blowout preventer as the ram block moves to the engagement position.

The guide surface may be concave with an apex along a central portion thereof and the retractable guide may have a notch extending through the apex with a puncture point of the blade extending beyond the notch for piercing the tubular. The retractable guide may be made of a pair of angled links operatively connected to an engagement end of the blade. The retractable guide may be made of a brittle material positionable along an engagement end of the blade, the brittle material releasable from the blade as the blade engages the tubular. The retractable guide may be made of a scissor link which may be made of a pair of cross plates having slots therein with a pin extending therethrough for slidable movement therebetween. The retractable guide may be made of a skid plate with either at least one arm pivotally connectable thereto or an airbag thereon inflatable about the tubular. The blade assembly may have a lip for selectively releasing the retractable guide to move between a guide position for engaging the tubular and a cutting position refracted a distance behind an engagement end of the blade.

In another aspect, the disclosure may relate to a blowout preventer for shearing a tubular of a wellbore penetrating a subterranean formation, the blowout preventer having a housing and a pair of blade assemblies. The housing has a hole therethrough for receiving the tubular. Each of the pair of blade assemblies has a ram block, a blade and a retractable guide. The ram block is movable between a non-engagement position and an engagement position about the tubular. The blade is carried by the ram block for cuttingly engaging the tubular. The retractable guide is carried on the ram block and slidably movable therealong. The retractable guide has a guide surface for urging the tubular into a desired location in the blowout preventer as the ram block moves to the engagement position.

The retractable guide and/or the blade of each of the pair of blade assemblies may be the same or may be different. The blowout preventer may further have at least one actuator for actuating the ram block of each of the blade assemblies.

Finally, in another aspect, the disclosure relates to a method for shearing a tubular of a wellbore penetrating a subterranean formation. The method includes providing a blowout preventer. The blowout preventer includes a housing (having a hole therethrough for receiving the tubular) and a pair of blade assemblies. Each blade assembly has a ram block, a blade carried on the ram block and a retractable guide with a guide surface thereon carried by the ram block. The method further involves urging the tubular into a desired location in the blowout preventer with the guide surface of each of the retractable guides while moving each of the ram blocks from a non-engagement position to an engagement position about the tubular, slidably moving the retractable guide along a ram block and cuttingly engaging the tubular with the pair of blades as the ram blocks are moved to the engagement position.

The method may further involve selectively releasing the retractable guides to move between a guide position for engaging the tubular to a cutting position a distance behind an engagement end of the blade, biasing the guides toward the guide position, urging the tubular along a curved surface of the guides toward an apex along a center thereof, and/or advancing the tubular to a central portion of the blowout preventer with the retractable guides. Each of the blade assemblies may be positionable on opposite sides of the tubular.

BRIEF DESCRIPTION OF THE DRAWINGS

So that the above recited features and advantages of the present disclosure can be understood in detail, a more particular description of the disclosure, briefly summarized above, may be had by reference to the embodiments thereof that are illustrated in the appended drawings. It is to be noted, however, that the appended drawings illustrate only typical embodiments and are, therefore, not to be considered limiting of its scope, for the disclosure may admit to other equally effective embodiments. The figures are not necessarily to scale and certain features, and certain views of the figures may be shown exaggerated in scale or in schematic in the interest of clarity and conciseness.

DETAILED DESCRIPTION

The description that follows includes exemplary apparatus, methods, techniques, and instruction sequences that embody techniques of the present subject matter. However, it is understood that the described embodiments may be practiced without these specific details.

The techniques herein relate to blade assemblies for blowout preventers. These blade assemblies are configured to provide tubular centering and shearing capabilities. Retractable guides and/or release mechanisms may be used to position the tubulars during shearing. It may be desirable to provide techniques for positioning the tubular prior to severing the tubular. It may be further desirable that such techniques be performed on any sized tubular, such as those having a diameter of up to about 8½" (21.59 cm) or more. Such techniques may involve one or more of the following, among others: positioning of the tubular, efficient parts replacement, reduced wear on blade, less force required to sever the tubular, efficient severing, and less maintenance time for part replacement.

Figure 1:
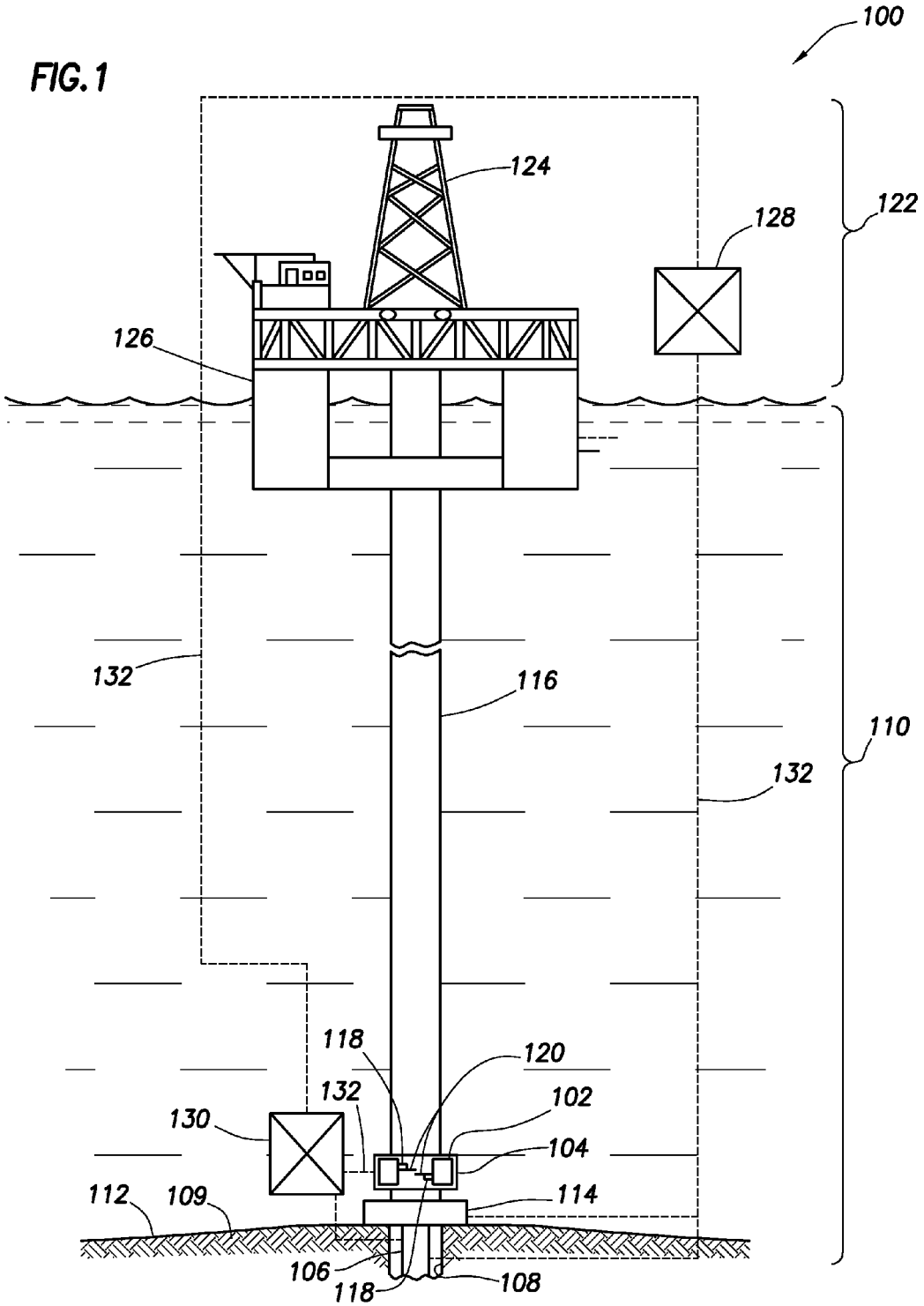
FIG. 1 is a schematic view of an offshore wellsite having a blowout preventer (BOP) with a blade assembly.

FIG. 1 depicts an offshore wellsite 100 having a blade assembly 102 in a housing 105 of a blowout preventer (BOP) 104. The blade assembly 102 may be configured to center a tubular 106 in the BOP 104 prior to or concurrently with a severing of the tubular 106. The tubular 106 may be fed through the BOP 104 and into a wellbore 108 penetrating a subterranean formation 109. The BOP 104 may be part of a subsea system 110 positioned on a floor 112 of the sea. The subsea system 110 may also comprise the tubular (or pipe) 106 extending from the wellbore 108, a wellhead 114 about the wellbore 108, a conduit 116 extending from the wellbore 108 and other subsea devices, such as a stripper and a conveyance delivery system (not shown).

The blade assembly 102 may have at least one tubular centering system 118 and at least one blade 120. The tubular centering system 118 may be configured to center the tubular 106 within the BOP 104 prior to and/or concurrently with the blade 120 engaging the tubular 106, as will be discussed in more detail below. The tubular centering system 118 may be coupled to, or move with, the blade 120, thereby allowing the centering of the tubular 106 without using extra actuators, or the need to machine the BOP 104 body.

While the offshore wellsite 100 is depicted as a subsea operation, it will be appreciated that the wellsite 100 may be land or water based, and the blade assembly 102 may be used in any wellsite environment. The tubular 106 may be any suitable tubular and/or conveyance for running tools into the wellbore 108, such as certain downhole tools, pipe, casing, drill tubular, liner, coiled tubing, production tubing, wireline, slickline, or other tubular members positioned in the wellbore and associated components, such as drill collars, tool joints, drill bits, logging tools, packers, and the like (referred to herein as "tubular" or "tubular strings").

A surface system 122 may be used to facilitate operations at the offshore wellsite 100. The surface system 122 may comprise a rig 124, a platform 126 (or vessel) and a surface controller 128. Further, there may be one or more subsea controllers 130. While the surface controller 128 is shown as part of the surface system 122 at a surface location, and the subsea controller 130 is shown as part of the subsea system 110 in a subsea location, it will be appreciated that one or more surface controllers 128 and subsea controllers 130 may be located at various locations to control the surface and/or subsea systems.

To operate the blade assembly 102 and/or other devices associated with the wellsite 100, the surface controller 128 and/or the subsea controller 130 may be placed in communication therewith. The surface controller 128, the subsea controller 130, and/or any devices at the wellsite 100 may communicate via one or more communication links 132. The communication links 132 may be any suitable communication system and/or device, such as hydraulic lines, pneumatic lines, wiring, fiber optics, telemetry, acoustics, wireless communication, any combination thereof, and the like. The blade assembly 102, the BOP 104, and/or other devices at the wellsite 100 may be automatically, manually, and/or selectively operated via the surface controller 128 and/or subsea controller 130.

Figure 2:
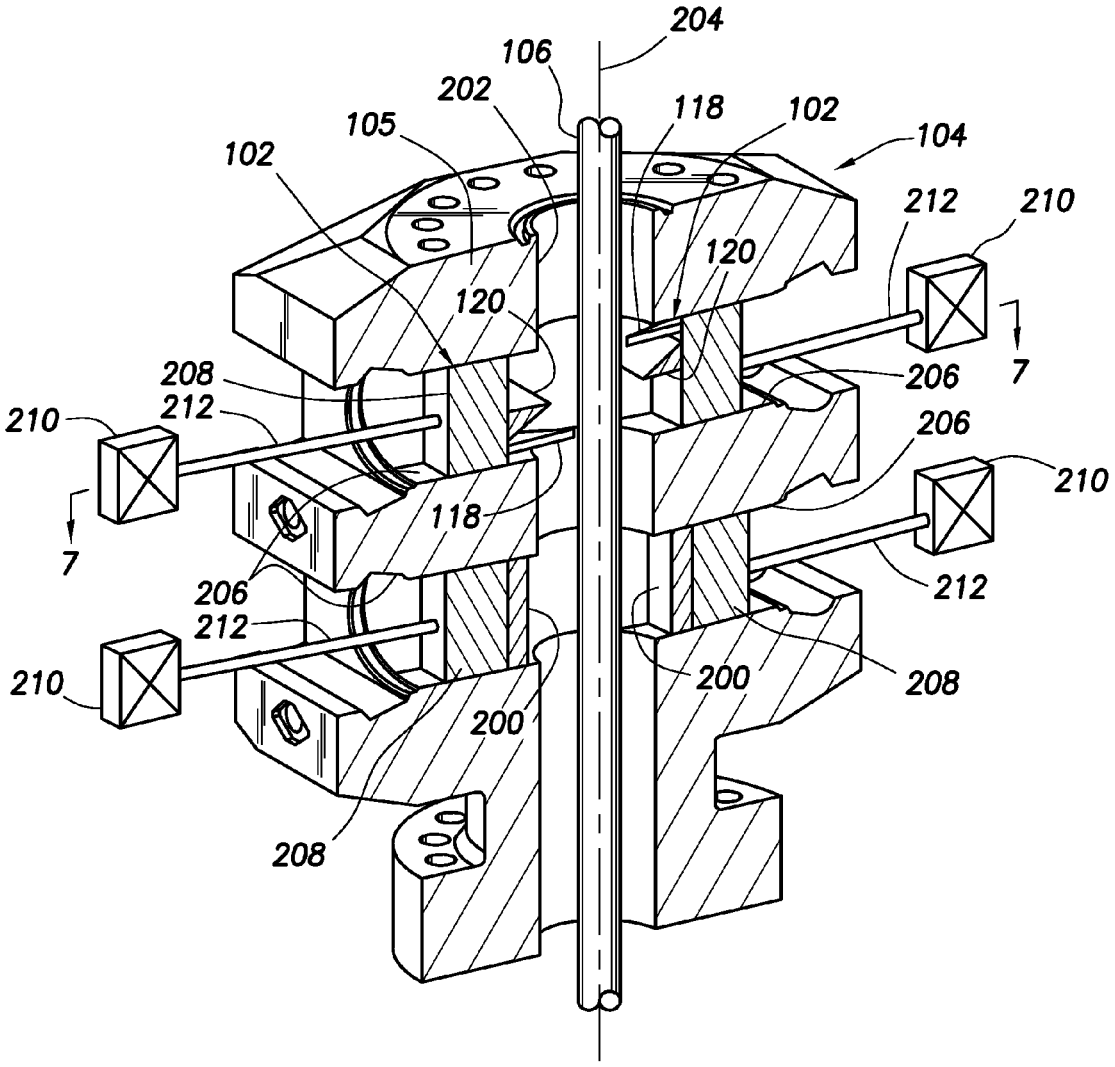
FIG. 2 is a schematic view, partially in cross-section, of the BOP of FIG. 1 prior to initiating a BOP operation.

FIG. 2 shows a schematic, cross-sectional view of the BOP 104 of FIG. 1 having the blade assembly 102 and a seal assembly 200. The BOP 104, as shown, has a hole 202 through a central axis 204 of the BOP 104. The hole 202 may be for receiving the tubular 106. The BOP 104 may have one or more channels 206 for receiving the blade assembly 102 and/or the seal assembly 200. As shown, there are two channels 206, one having the blade assembly 102 and the other having the seal assembly 200 therein. Although, there are two channels 206, it should be appreciated that there may be any number of channels 206 housing any number of blade assemblies 102 and/or seal assemblies 200. The channels 206 may be configured to guide the blade assembly 102 and/or the seal assembly 200 radially toward and away from the tubular 106.

The BOP 104 may allow the tubular 106 to pass through the BOP 104 during normal operation, such as run in, drilling, logging, and the like. In the event of an upset, a pressure surge, or other triggering event, the BOP 104 may sever the tubular 106 and/or seal the hole 202 in order to prevent fluids from being released from the wellbore 108. While the BOP 104 is depicted as having a specific configuration, it will be appreciated that the BOP 104 may have a variety of shapes, and be provided with other devices, such as sensors (not shown). An example of a BOP that may be used is described in U.S. Pat. No. 5,735,502, the entire contents of which are hereby incorporated by reference.

The blade assembly 102 may have the tubular centering system 118 and the blades 120 each secured to a ram block 208. Each of the ram blocks 208 may be configured to hold (and carry) the blade 120 and/or the tubular centering system 118 as the blade 120 is moved within the BOP 104. The ram blocks 208 may couple to actuators 210 via ram shafts 212 in order to move the blade assembly 102 within the channel 206. The actuator 210 may be configured to move the ram shaft 212 and the ram blocks 208 between an operating (or non-engagement) position, as shown in FIG. 2, and an actuated (or engagement) position wherein the ram blocks 208 have engaged and/or severed the tubular 106 and/or sealed the hole 202. The actuator 210 may be any suitable actuator, such as a hydraulic actuator, a pneumatic actuator, a servo, and the like. The seal assembly 200 may also be used to center the tubular 106 in addition to, or as an alternative to the tubular centering system 118.

Figure 3:
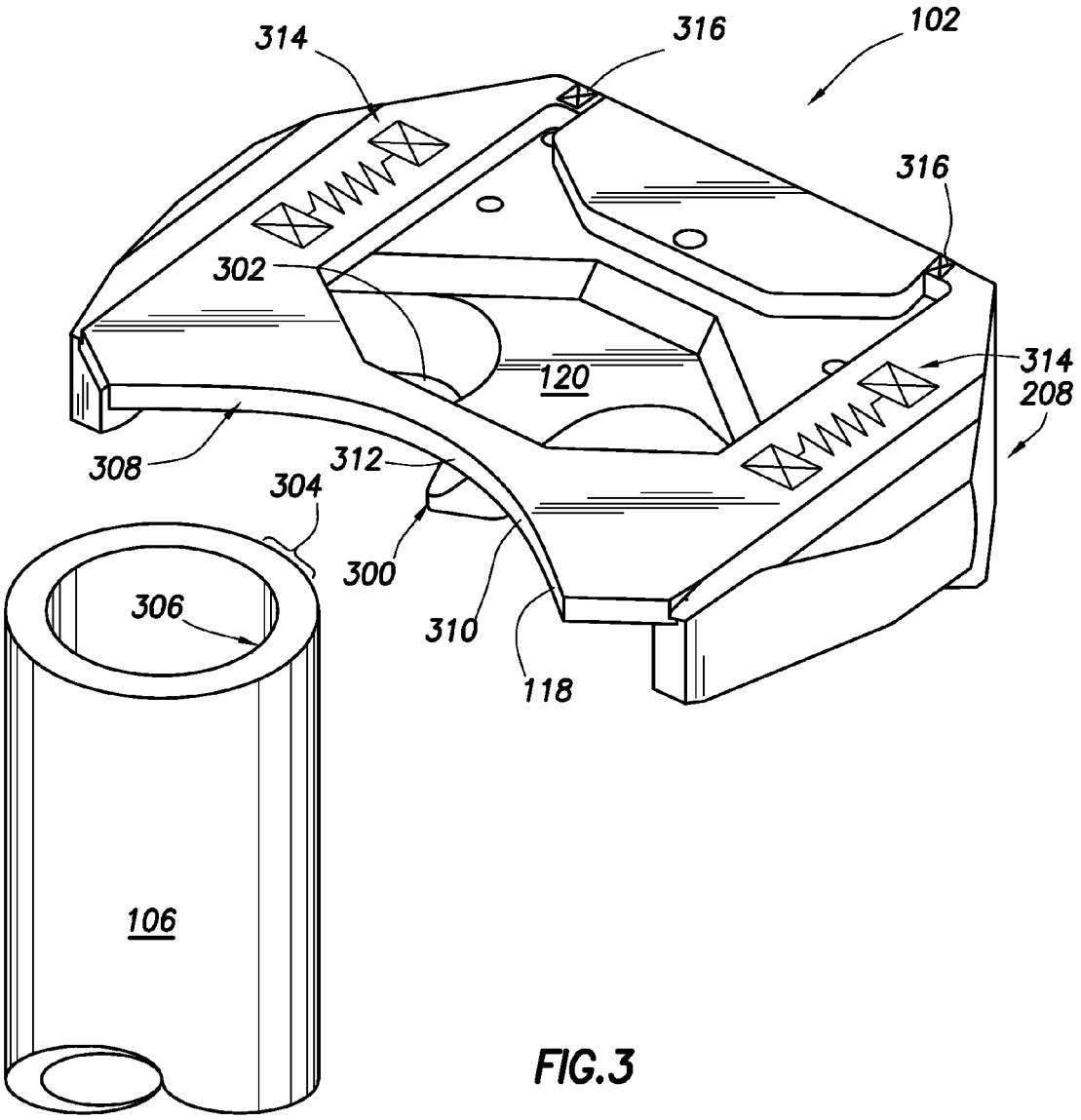
FIG. 3-6 are various schematic views of a portion of the blade assembly of FIG. 1 having a blade and a tubular centering system.

FIG. 3 is a schematic perspective view of a portion of the blade assembly 102 having the blade 120 and the tubular centering system 118. The blade 120 and tubular centering system 118 are supported by one of the ram blocks 208. It should be appreciated that there may be another ram block 208 holding another of the blades 120 and/or the tubular centering systems 118 working in cooperation therewith, as shown in FIG. 2. The blade 120, as shown, is configured to sever the tubular 106 using multi-phase shearing. The blade 120 may have a puncture point 300 and one or more troughs 302 along an engagement end of the blade. Further, any suitable blade for severing the tubular 106 may be used in the blade assembly 102, such as the blades disclosed in U.S. Pat. Nos. 7,367,396; 7,814,979; Ser. Nos. 12/883,469; 13/118,200; 13/118,252; and/or 13/118,289, the entire contents of which are hereby incorporated by reference.

The tubular centering system 118 may be configured to locate the tubular 106 at a central location in the BOP 104 (as shown, for example, in FIG. 2). The central location is a location wherein the puncture point 300 may be aligned with a central portion 304 of the tubular 106. In the central location, the puncture point 300 may pierce a tubular wall 306 of the tubular 106 proximate the central portion 304 of the tubular 106. In order for the puncture point 300 to pierce the tubular 106 as desired, it may be required to center the tubular 106 prior to, or concurrent with, engaging the tubular 106 with the blade 120.

The tubular centering system 118, as shown in FIG. 3, may have a retractable guide 308 configured to engage the tubular 106 prior to the blade 120. The guide 308 may have any suitable shape for engaging the tubular 106 and moving (or urging) the tubular 106 toward the central location as the ram block 208 moves toward the tubular 106. As shown, the guide 308 is a curved, concave or C-shaped, surface 310 having an apex 312 that substantially aligns with the puncture point 300 along a central portion of the surface 310 at an engagement end thereof. The curved surface 310 may engage the tubular 106 prior to the blade 120 as the ram block 208 moves the blade assembly 102 radially toward the tubular 106. The curved surface 310 may guide the tubular toward the apex 312 with the continued radial movement of the ram block 208 until the tubular 106 is located proximate the apex 312.

The tubular centering system 118 may have one or more biasing members 314 and/or one or more frangible members 316. The biasing members 314 and/or the frangible members 316 may be configured to allow the guide 308 to collapse and/or move relative to the blade 120 as the blade 120 continues to move toward and/or engage the tubular 106. Therefore, the guide 308 may engage and align the tubular 106 to the central location in the BOP 104 (as shown in FIGS. 1 and 2). The biasing members 314 and/or the frangible member(s) 316 may then allow the guide 308 to move as the blade 120 engages and severs the tubular 106. Either the biasing members 314 or the frangible members 316 may be used to allow the guide 308 to move relative to the blade 120. Further, both the biasing member 314 and the frangible member 316 may be used together as redundant systems to ensure the ram blocks 208 are not damaged. In the case where both the biasing members 314 and the frangible members 316 are used together, the biasing members 314 may require a guide force to move the guide 308, greater than the guide force required to break the frangible members 316.

The biasing members 314 may be any suitable device for allowing the guide 308 to center the tubular 106 and move relative to the blade 120 with continued radial movement of the ram block 208. A biasing force produced by the biasing members 314 may be large enough to maintain the guide 308 in a guiding position until the tubular 106 is centered at the apex 312. With continued movement of the ram block 208, the biasing force may be overcome. The biasing member 314 may then allow the guide 308 to move relative to the blade 120 as the blade 120 continues to move toward and/or through the tubular 106. When the ram block 208, if moved back toward the operation position (as shown in FIG. 2) and/or when the tubular 106 is severed, the biasing member 314 may move the guide 308 to the initial position, as shown in FIG. 3. The biasing members 314 may be any suitable device for biasing the guide 308, such as a leaf spring, a resilient material, a coiled spring and the like.

The frangible members 316 may be any suitable device for allowing the guide 308 to center the tubular 106 and then disengage from the blade 120. The frangible member(s) 316 may allow the guide 308 to center the tubular 106 in the BOP 104. Once the tubular 106 is centered, the continued movement of the ram block 208 toward the tubular 106 may increase the force on the frangible members 316 until a disconnect force is reached. When the disconnect force is reached, the frangible member(s) 316 may break, thereby allowing the guide 308 to move or remain stationary as the blade 120 engages and/or pierces the tubular 106. The frangible member(s) 316 may be any suitable device or system for allowing the guide to disengage the blades 120 when the disconnect force is reached, such as a shear pin, and the like.

Figure 4:
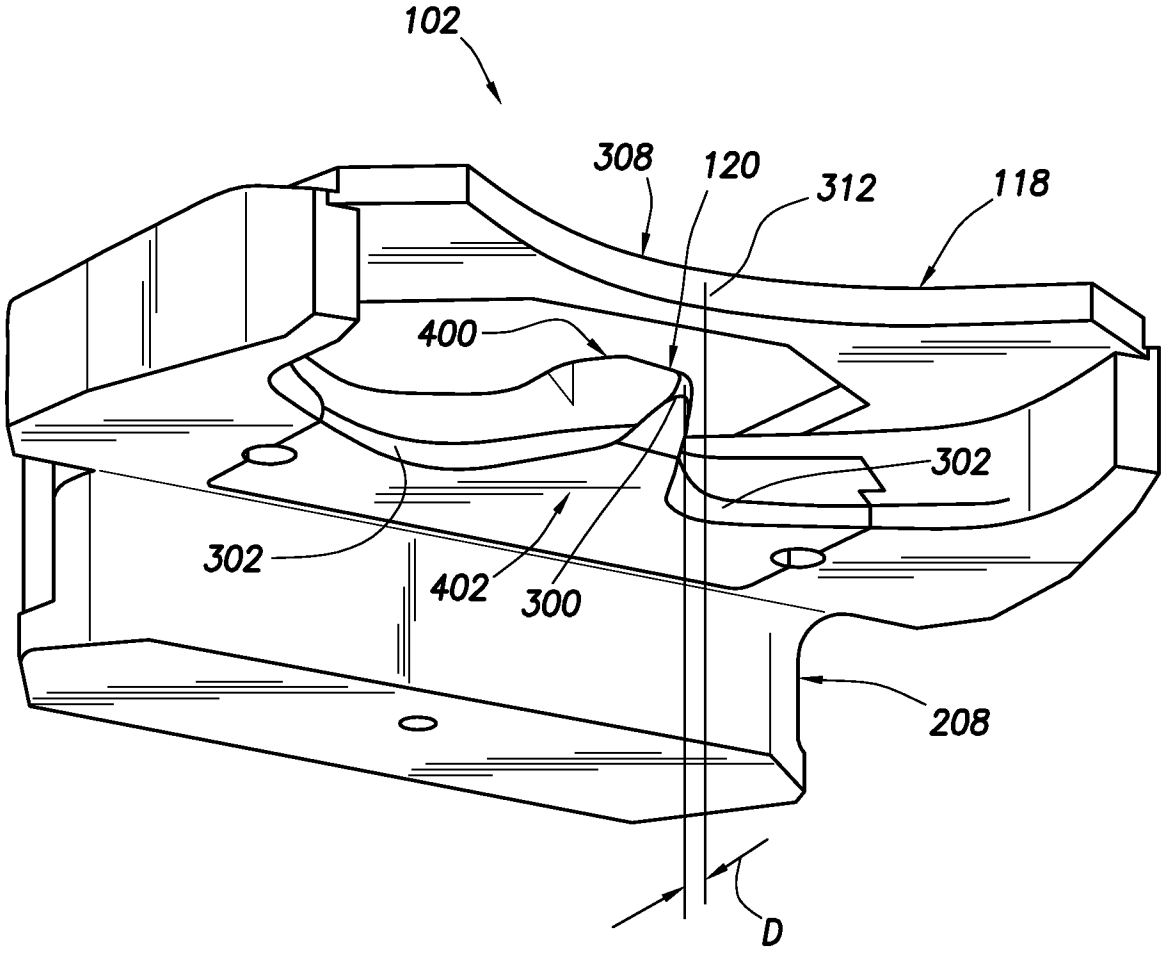

FIG. 4 is an alternate view of the portion of the blade assembly 102 of FIG. 3. The guide 308, as shown, has the apex 312 located a distance D in the radial direction from the puncture point 300. The tubular centering system 118 may be located on a top 400 of the blade 120 thereby allowing an opposing blade 120 (shown in FIG. 2) to pass proximate the blade 120 as the tubular 106 is severed. The opposing blade 120 may have the tubular centering system 118 located on a bottom 402 of the blade 120. The ram block 208 may be any suitable ram block configured to support the blade 120 and/or the tubular centering system 118.

Figure 5:
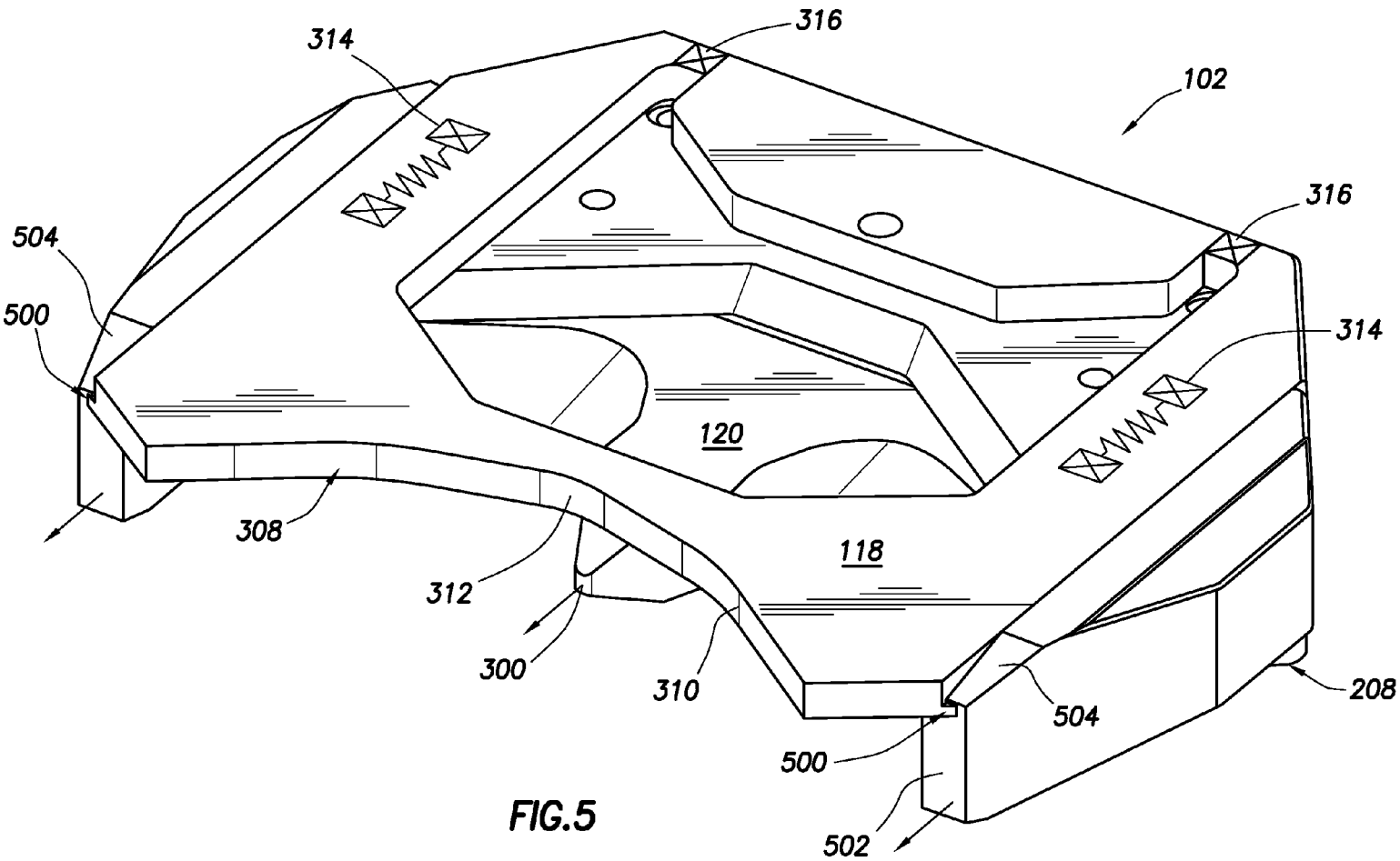

FIG. 5 is another view of the portion of the blade assembly 102 of FIG. 3. As shown, the tubular centering system 118 may have a release mechanism (or lip) 500 configured to maintain the guide 308 in a guide position, as shown. The lip 500 may be any suitable upset, or shoulder, for engaging a ram block surface 502. The lip 500 may maintain the guide 308 in the guide position until the force in the guide 308 becomes large, and a disconnect force is reached as a result of the tubular 106 reaching the apex 312. The continued movement of the ram block 208 may deform, and/or displace the lip 500 from the ram block surface 502. The lip 500 may then travel along a ramp 504 of the ram block 208 as the guide 308 displaces relative to the blade 120.

Figure 6:
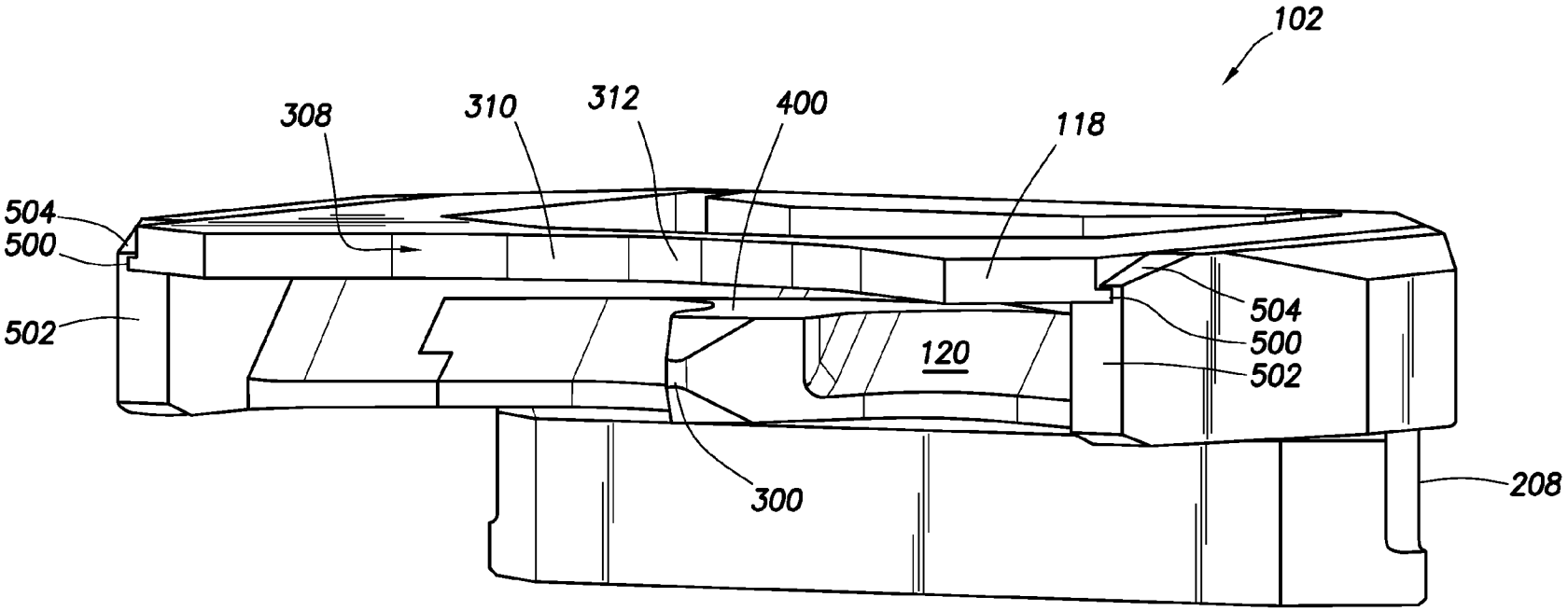

FIG. 6 is another view of the blade assembly 102 of FIG. 4. The tubular centering system 118 is shown in the guide position. In the guide position, the guide 308 has not moved and/or broken off and is located above the top 400 of the blade 120. The lip 500 may be engaged with the ram block surface 502 for extra support of the guide 308.

Figure 7:
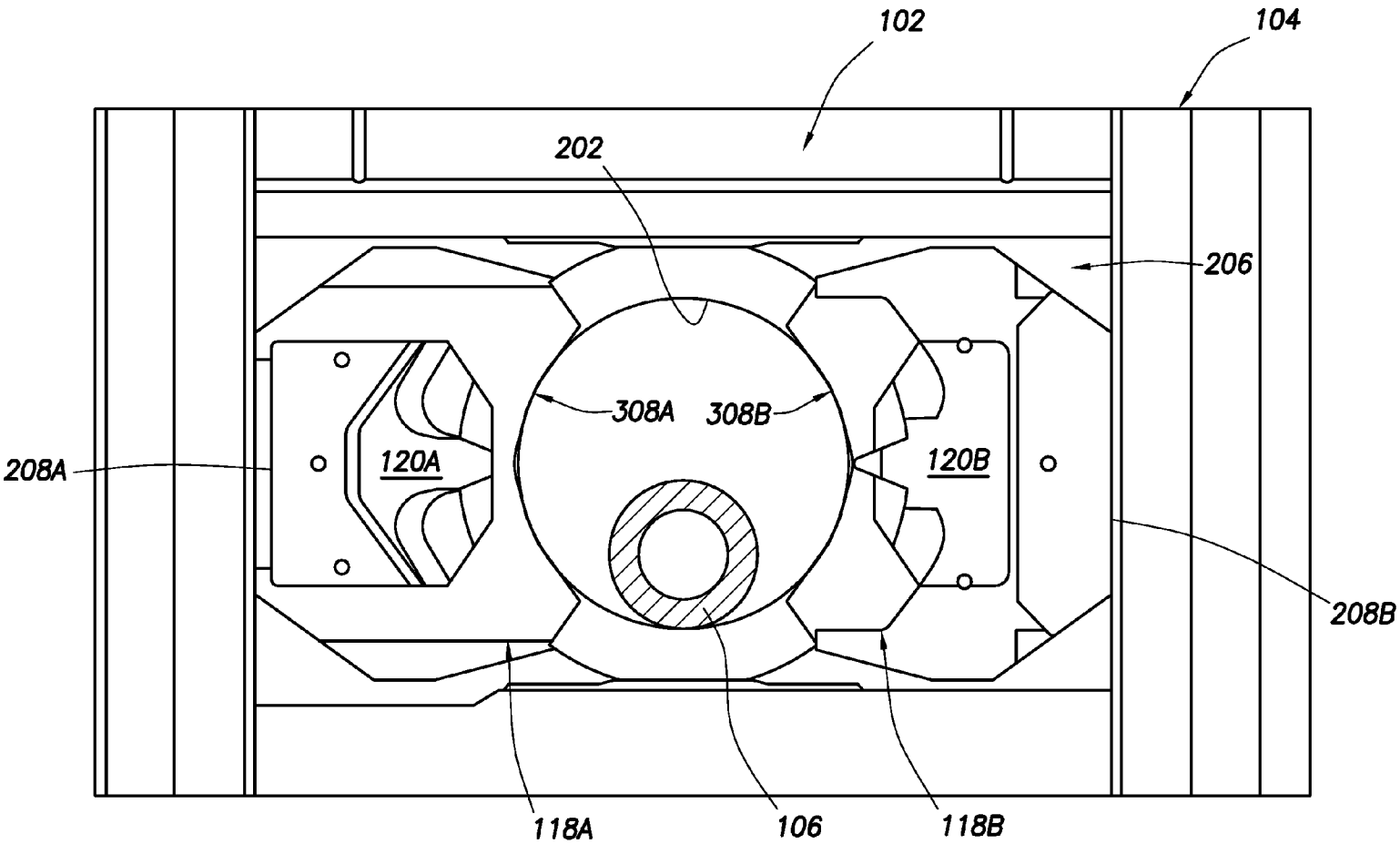
FIGS. 7-17 are schematic views of a portion of a cross-section of the BOP 104 of FIG. 2 taken along line 7-7 and depicting the blade assembly severing a tubular.

FIGS. 7-17 are schematic views of a portion of a cross-section of the BOP 104 of FIG. 2 taken along line 7-7 and depicting the blade assembly 102 severing (or shearing) the tubular 106. FIG. 7 shows the BOP 104 in an initial operating position. The blade assembly 102 includes a pair of opposing tubular severing systems 118A and 118B, blades 120A and 120B and ram blocks 208A and 208B for engaging tubular 106. As shown in each of the figures, the pair of opposing blade assemblies 102 (and their corresponding severing systems 118A,B and blades 120A,B) are depicted as being the same and symmetrical about the BOP, but may optionally have different configurations (such as those shown herein).

In the operating position, the tubular 106 is free to travel through the hole 202 of the BOP 104 and perform wellsite operations. The ram blocks 208A and 208B are retracted from the hole 202, and the guides 308A and 308B of the tubular centering systems 118A and 118B may be positioned radially closer to the tubular 106 than the blades 120A and 120B. The blade assembly 102 may remain in this position until actuation is desired, such as after an upset occurs. When the upset occurs, the blade assembly 102 may be actuated and the severing operation may commence.

The tubular severing systems 118A,B, blades 120A,B and ram blocks 208A,B may be the same as, for example, the tubular severing system 118, blade 120 and ram block 208 of FIGS. 3-6. The severing system 118B, blade 120B and ram block 208B are inverted for opposing interaction with the severing system 118A, blade 120B and ram block 208B (shown in an upright position). The blade 120A (or top blade), may be the blade 120 (as shown in FIG. 2) configured to face up, or travel over the blade 120B (or bottom blade) which may be the same blade 120 of FIG. 2 configured to face down.

Figure 8:
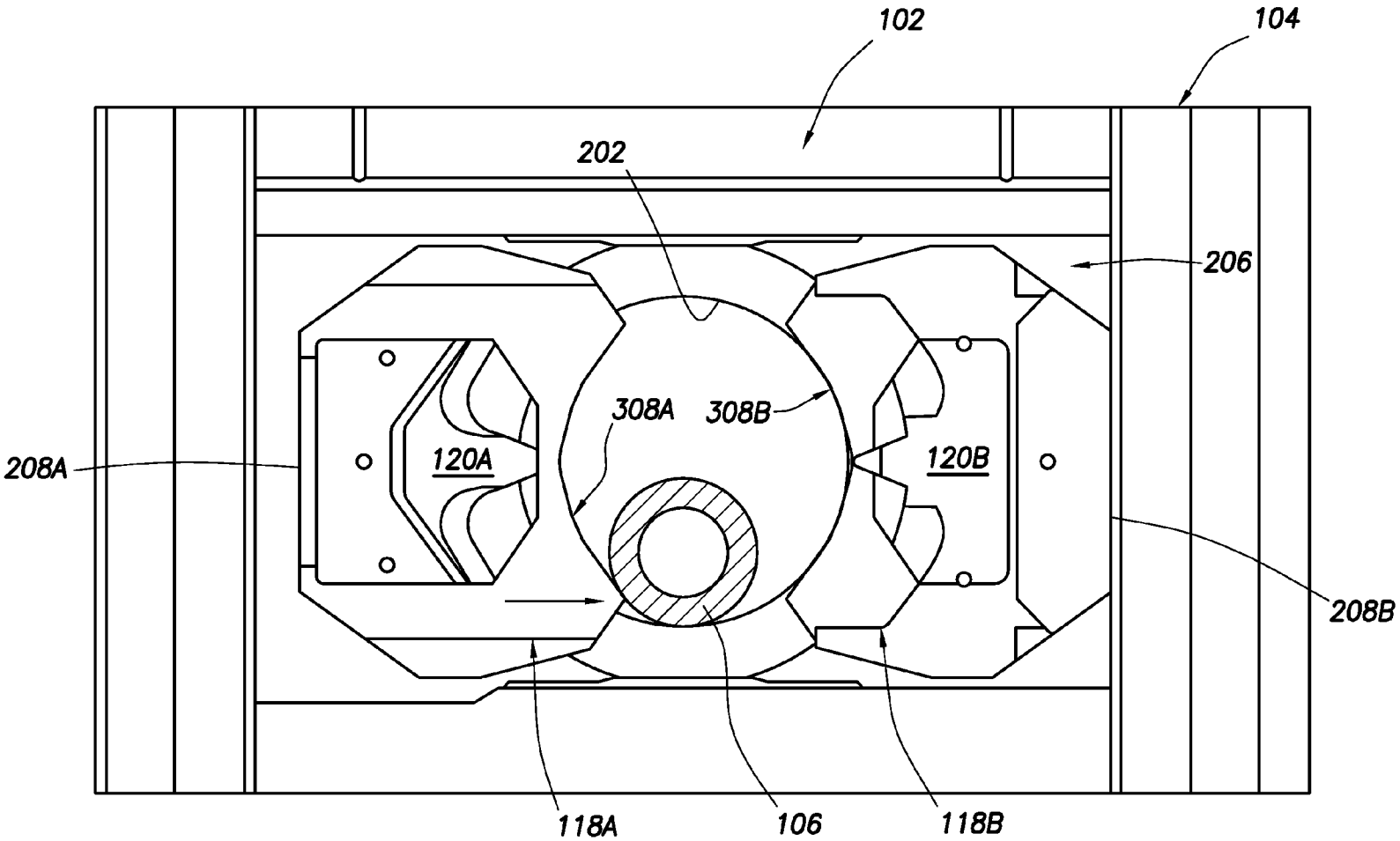

FIG. 8 shows the blade assembly 102 upon the commencement of the severing operation. As shown, the ram block 208A may have moved the blade 120A and the tubular centering system 118A into the hole 202 and toward the tubular 106. Although FIGS. 7-17 show the upper blade 120A (and the ram block 208A and pipe centering system 118A) moving first, the lower blade 120B may move first, or both blades 120A and 120B may move simultaneously. As the ram block 208A moves, the guide 308A engages the tubular 106.

Figure 9:
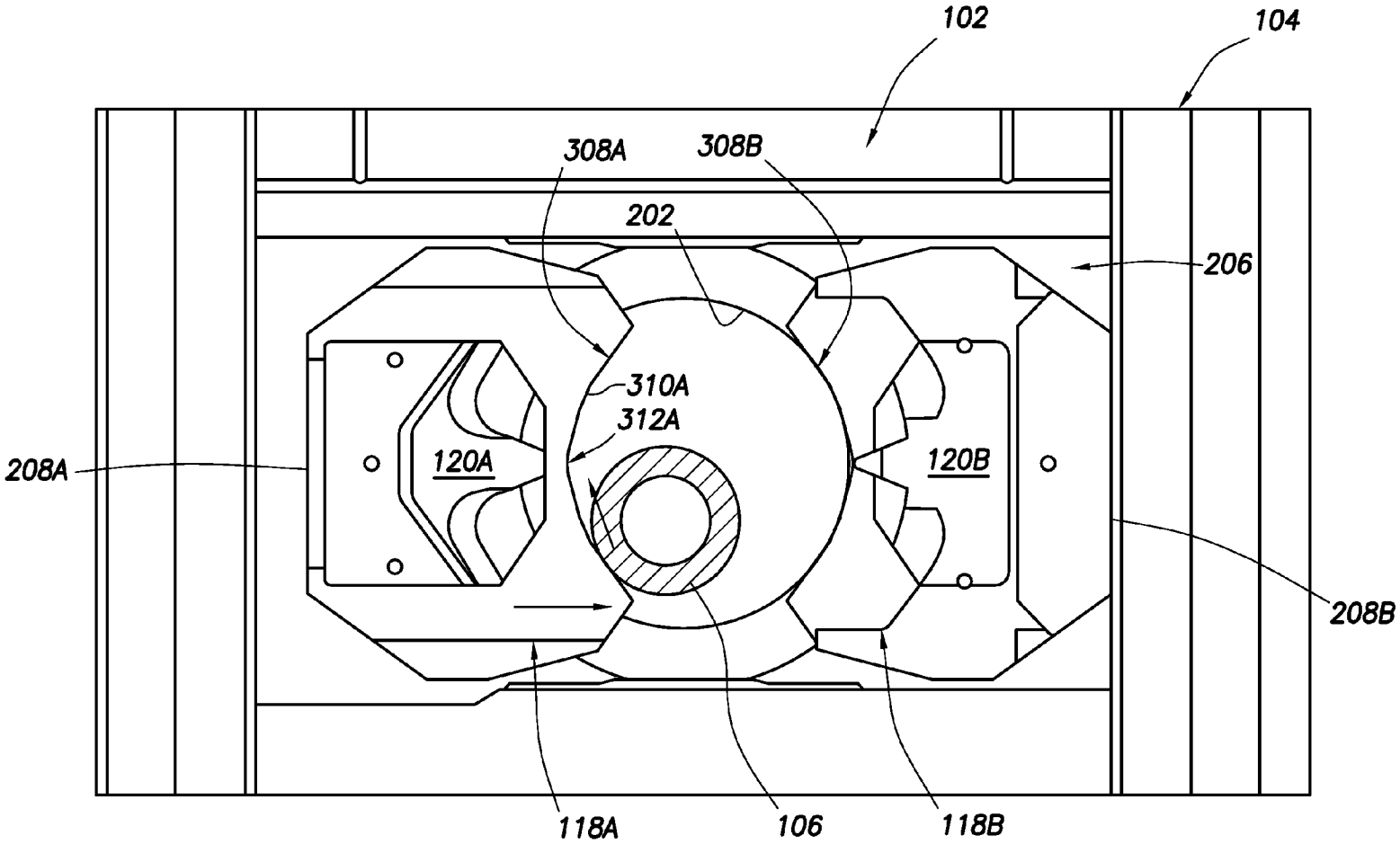
Figure 10:
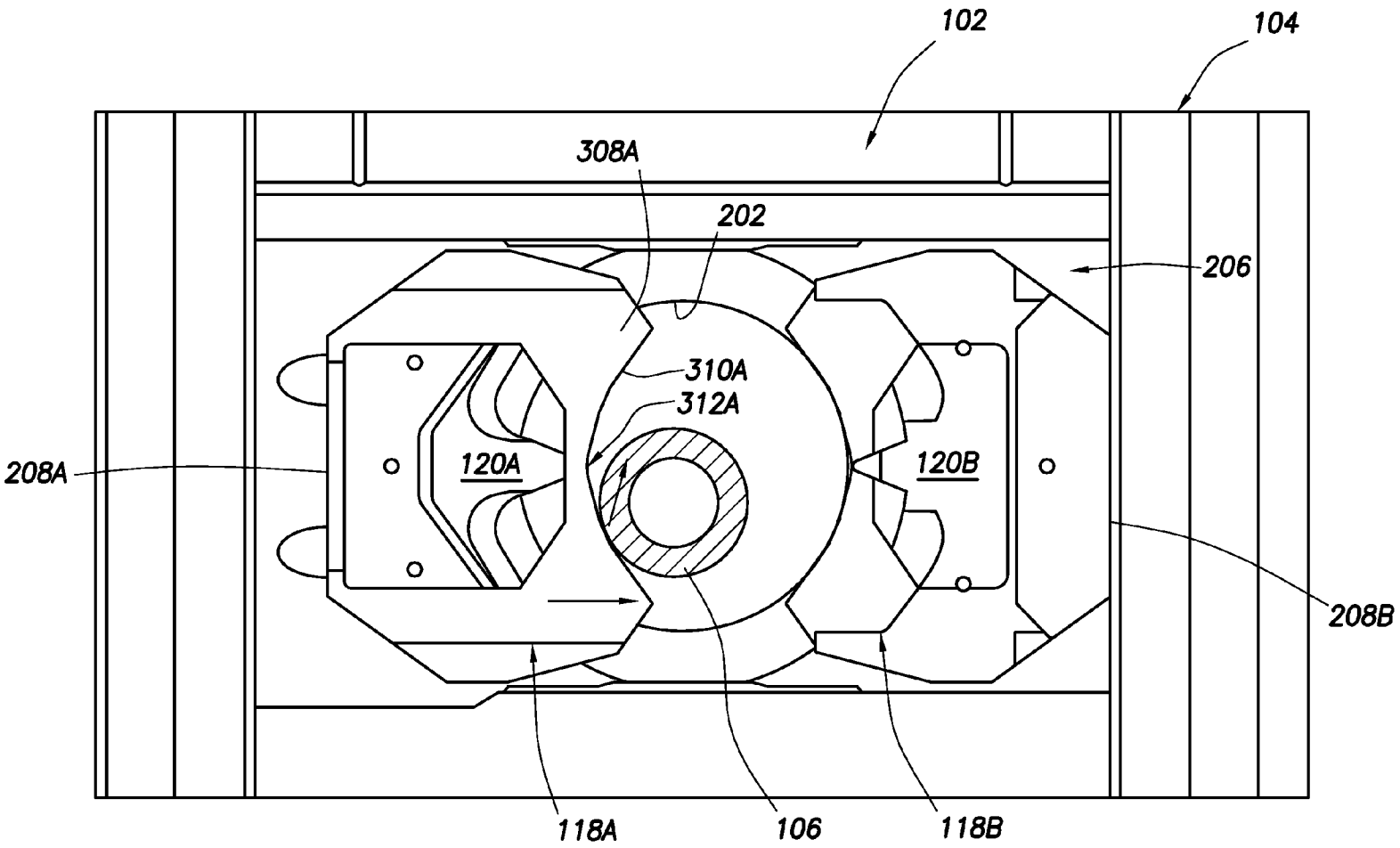

FIG. 9 shows the blade assembly 102 as the tubular 106 is initially being centered by the guide 308A. As the ram block 208A continues to move the blade 120A and the tubular centering system 118A radially toward the center of the BOP 104, the guide 308A starts to center the tubular 106. The tubular 106 may ride along a curved surface 310A of the guide 308A toward an apex 312A (in the same manner as the curved surface 310 and apex 312 of FIG. 3). As the tubular 106 rides along the curved surface 310A, the tubular 106 moves to a location closer to a center of the hole 202, as shown in FIG. 10.

Figure 11:
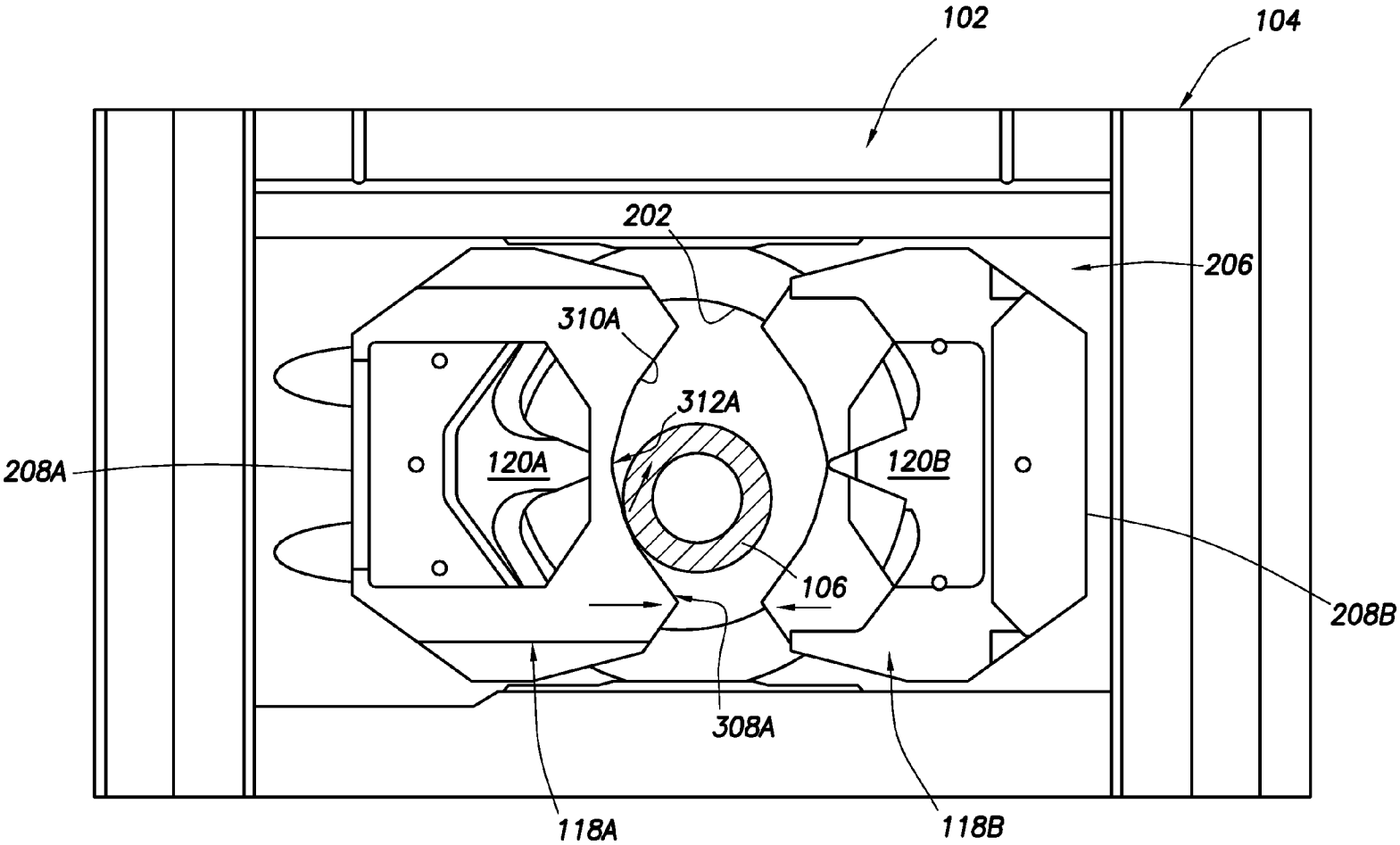

FIG. 11 shows the blade assembly 102 as the tubular 106 continues to ride along the guide 308A toward the apex 312A of the curved surface 310A and the other blade 120B (or bottom blade) is actuated. The blade 120B may then travel radially toward center of the hole 202 in order to engage the tubular 106.

Figure 12:
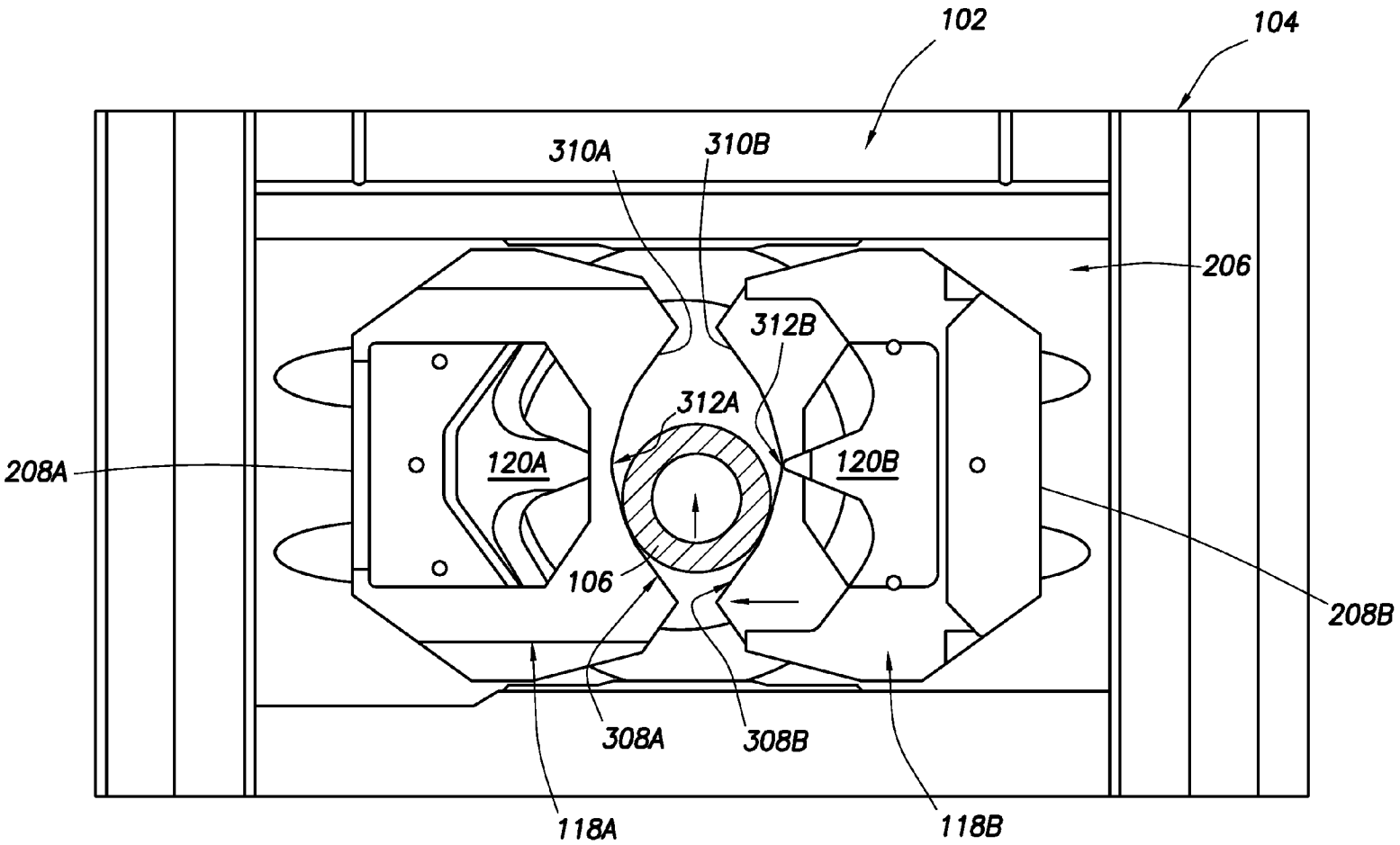

FIG. 12 shows the blade assembly 102 as both of the guides 308A and 308B engage the tubular 106 and continue to move the tubular 106 toward the apex 312A and 312B of the tubular centering systems 118A and 118B. The curved surface 310A and a curved surface 310B may wedge the tubular 106 between the tubular centering systems 118A and 118B as the ram blocks 208A and 208B continue to move the blades 120A and 120B toward the center of the BOP 104.

Figure 13:
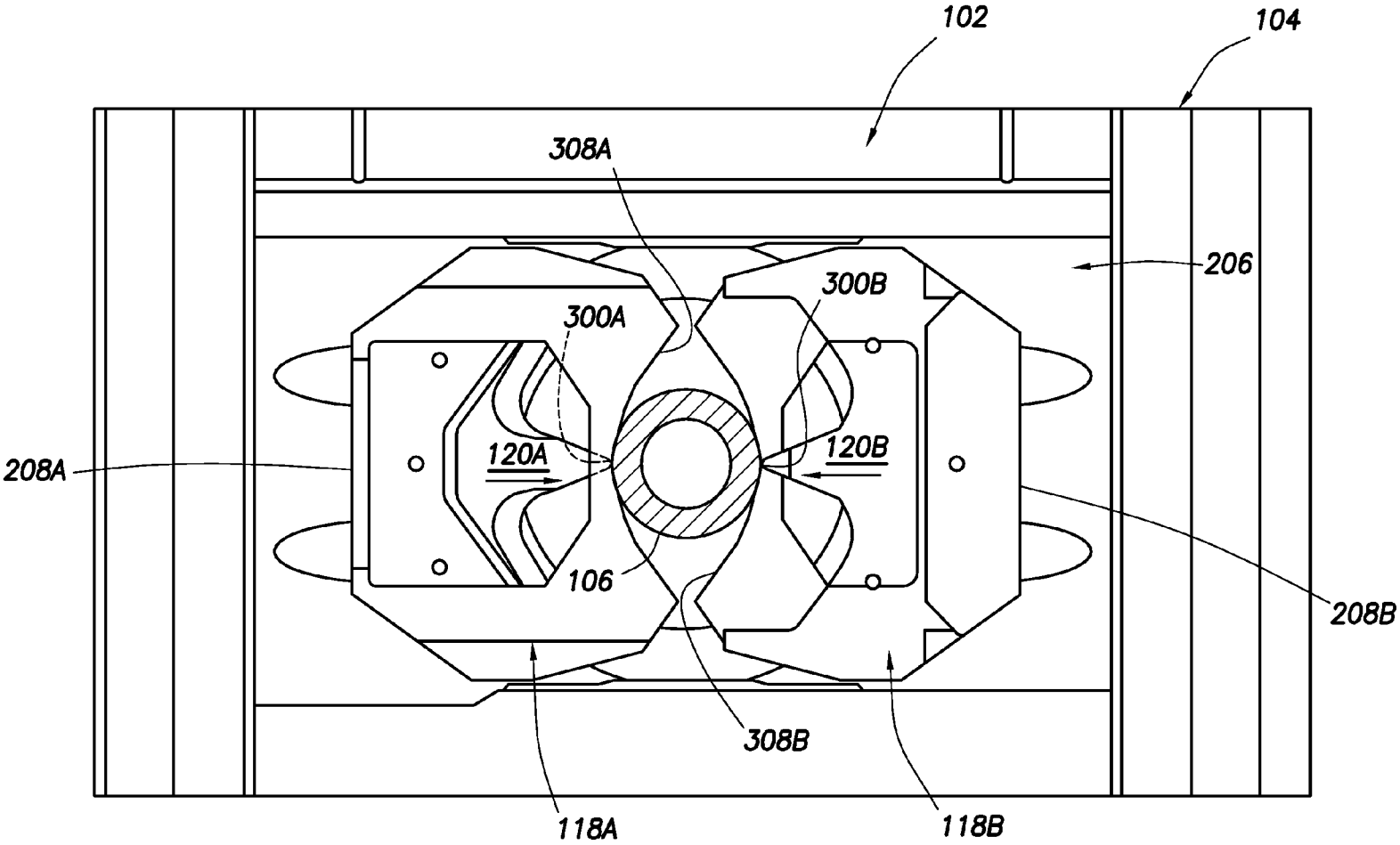

FIG. 13 shows the tubular 106 centered in the BOP 104 and aligned with puncture points 300A and 300B of the blades 120A and 120B. With the tubular 106 centered between the guides 308A and 308B, the continued radial movement of the ram blocks 208A and 208B will increase the force in the tubular centering systems 118A and 118B.

The force may increase in the tubular centering systems 118A and 118B until, the biasing force is overcome, and/or the disconnect force is reached. The guide(s) 308A and/or 308B may then move, or remain stationary relative to the blades 120A and 120B as the ram blocks 208A and 208B continue to move. The biasing force and/or the disconnect force for the tubular centering systems 118A and 118B may be the same, or one may be higher than the other, thereby allowing at least one of the blades 120A and/or 120B to engage the tubular 106.

Figure 14:
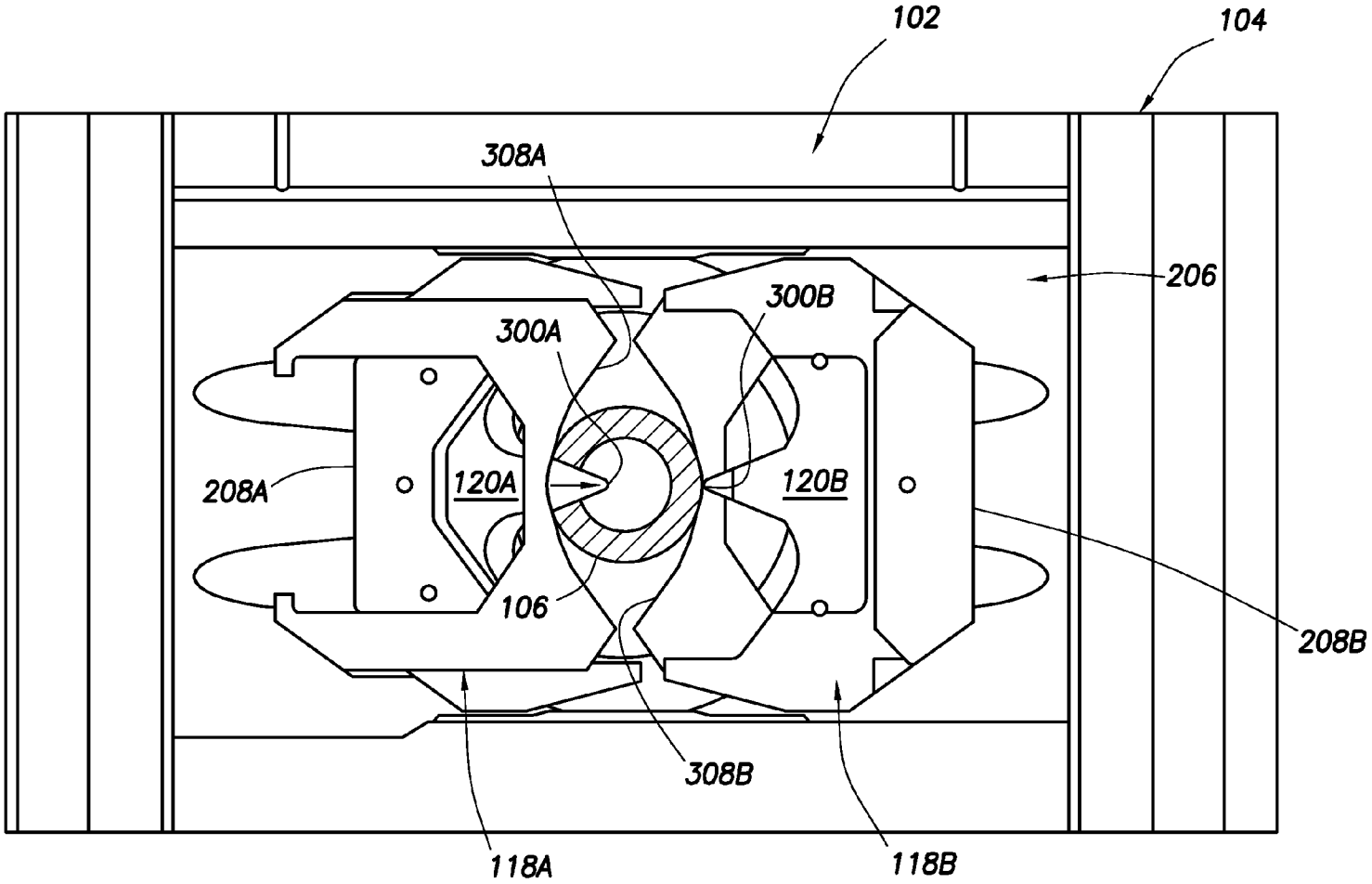

FIG. 14 shows the blade 120A puncturing the tubular 106. The blade 120A has moved relative to the guide 308A, thereby allowing the puncture point 300A to extend past the guide 308A and pierce the tubular 106. The tubular centering system 118B for the blade 120B (or the bottom blade) may still be engaged with the blade 120B thereby allowing the guide 308B to hold the tubular 106 in place as the puncture point 300A pierces the tubular 106.

Figure 15:
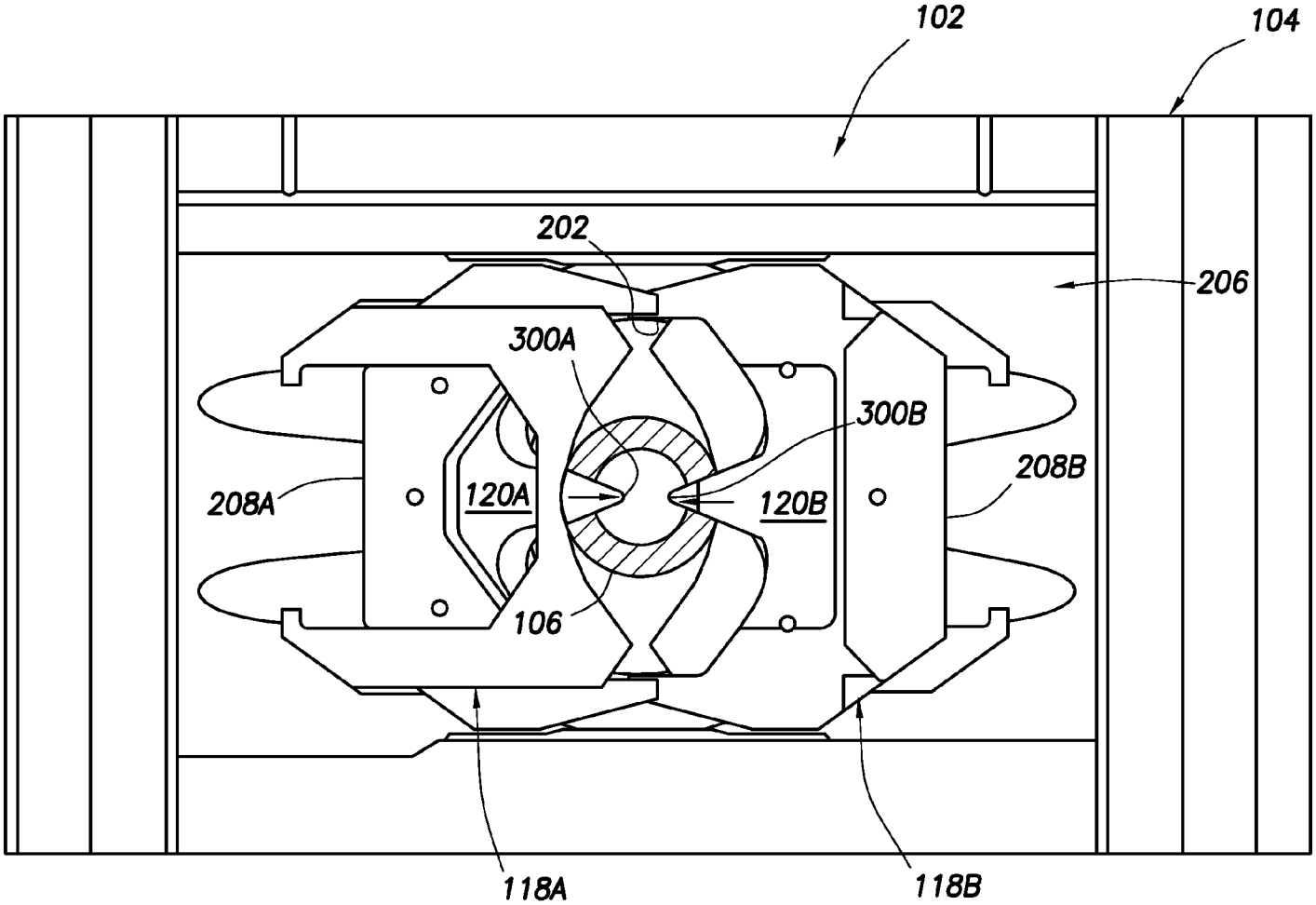

FIG. 15 shows both of the blades 120A and 120B puncturing the tubular 106. The tubular centering system 118B has been moved relative to the blade 120B (or bottom blade) thereby allowing the puncture point 300B to extend past the guide 308B and puncture the tubular 106.

Figure 16:
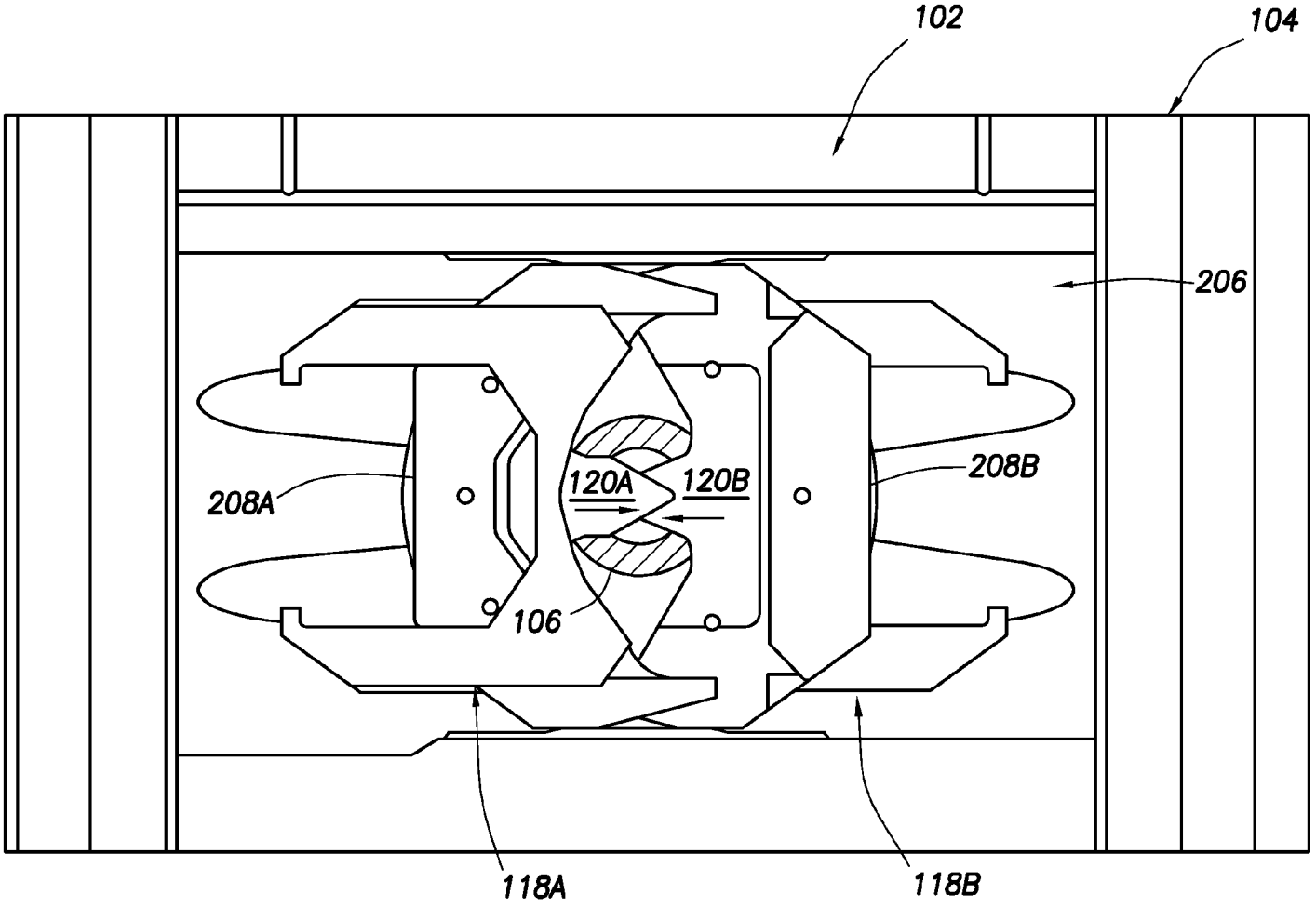
Figure 17:
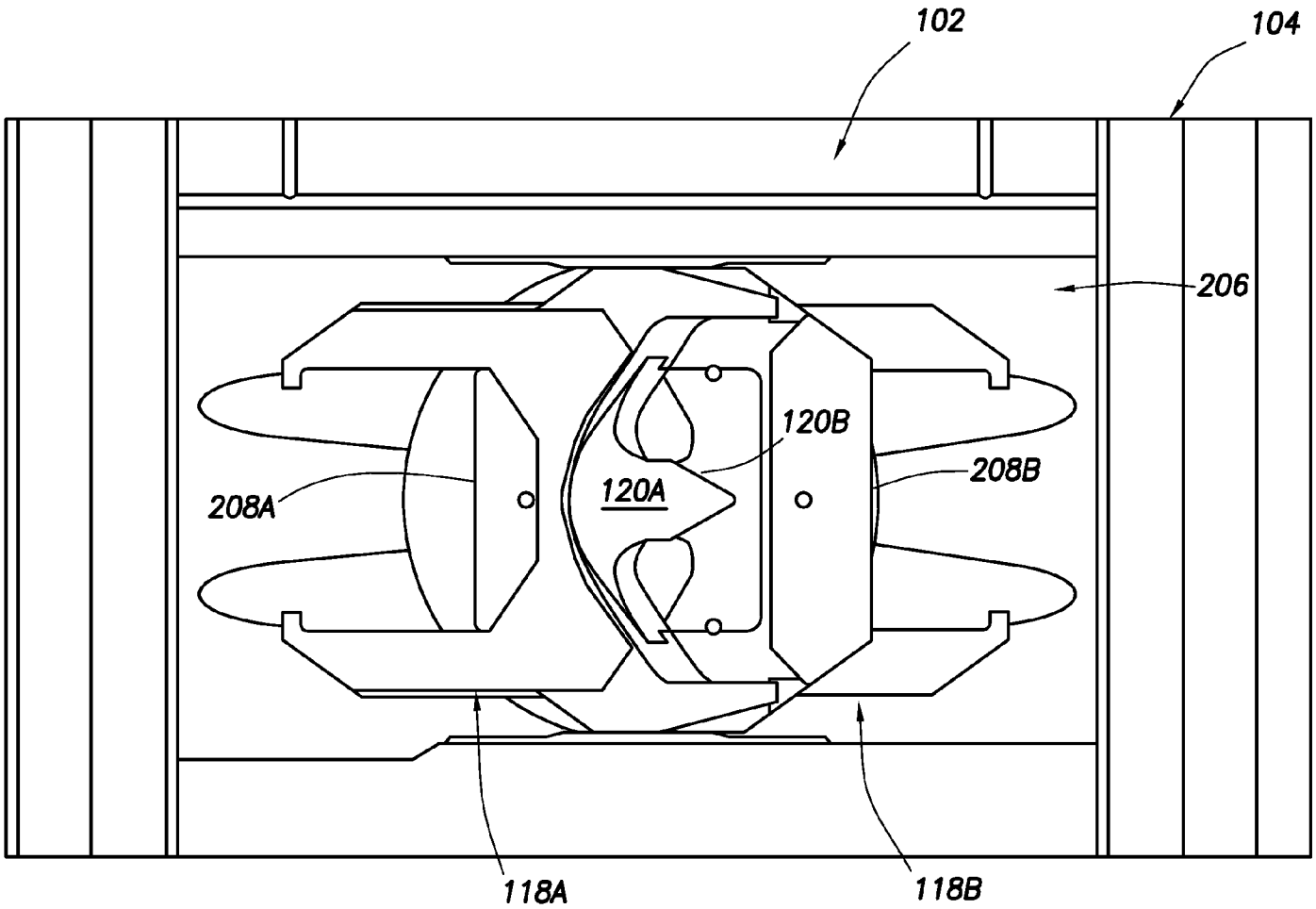

FIG. 16 shows the blades 120A and 120B continuing to shear the tubular 106 as the ram blocks 208A and 208B move radially toward one another in the channel 206. The top blade 120A is shown as passing over a portion of the bottom blade 120B. This movement is continued until the tubular 106 is severed as shown in FIG. 17.

FIGS. 18-24 are schematic views of the BOP 104 of FIG. 7 with various alternate tubular centering systems. The blade assembly 102 may be the same as described for FIGS. 1-17. In each of these figures, tubular 106 is schematically shown in two possible positions in the hole 202.

Figure 18:
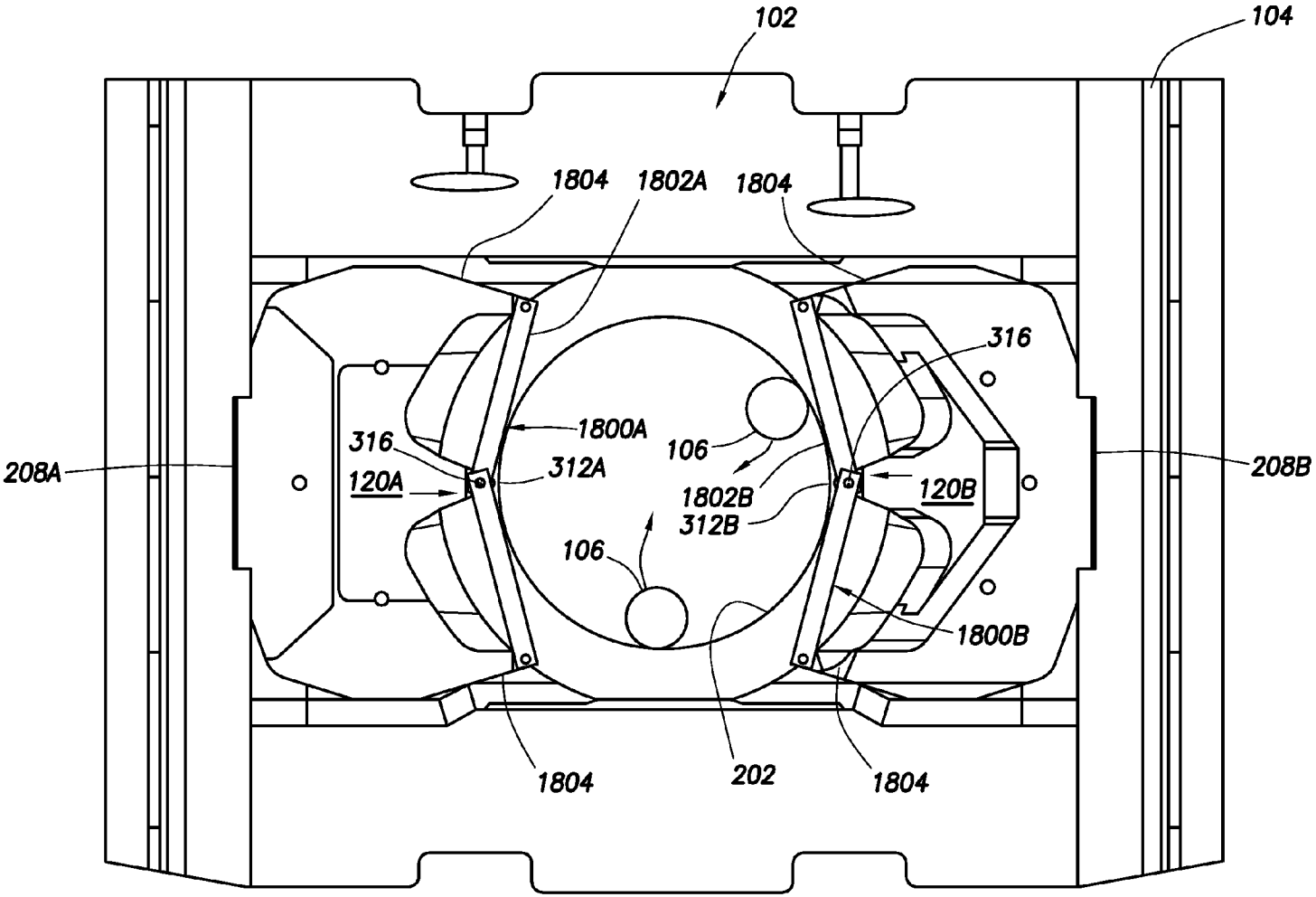
FIGS. 18-24 are schematic views of the BOP of FIG. 7 with various alternate tubular centering systems.

In FIG. 18, alternate tubular centering systems 1800A and 1800B may have one or more angled links 1802A and 1802B. The angled links 1802A and 1802B may couple to an outer arm 1804 of the ram blocks 208A and 208B. The angled links 1802A and 1802B are schematically shown about outer arms 1804, but may be positioned above, below and/or between components of the blade assembly 102 as desired.

The tubular 106 (shown in two possible positions although there may be only one) may be configured to travel, or ride, along the angled links 1802A and 1802B during the severing operation. As the ram blocks 208A and 208B move closer together, the tubular 106 may move to the apexes 312A and 312B of each of the angled links 1802A and 1802B. The angled links 1802A and 1802B may have the frangible member 316 located between the angled links 1802A and 1802B proximate the apexes 312A and 312B. Further, the frangible member 316 may be replaced by a biasing member (as shown in FIG. 3).

Figure 19:
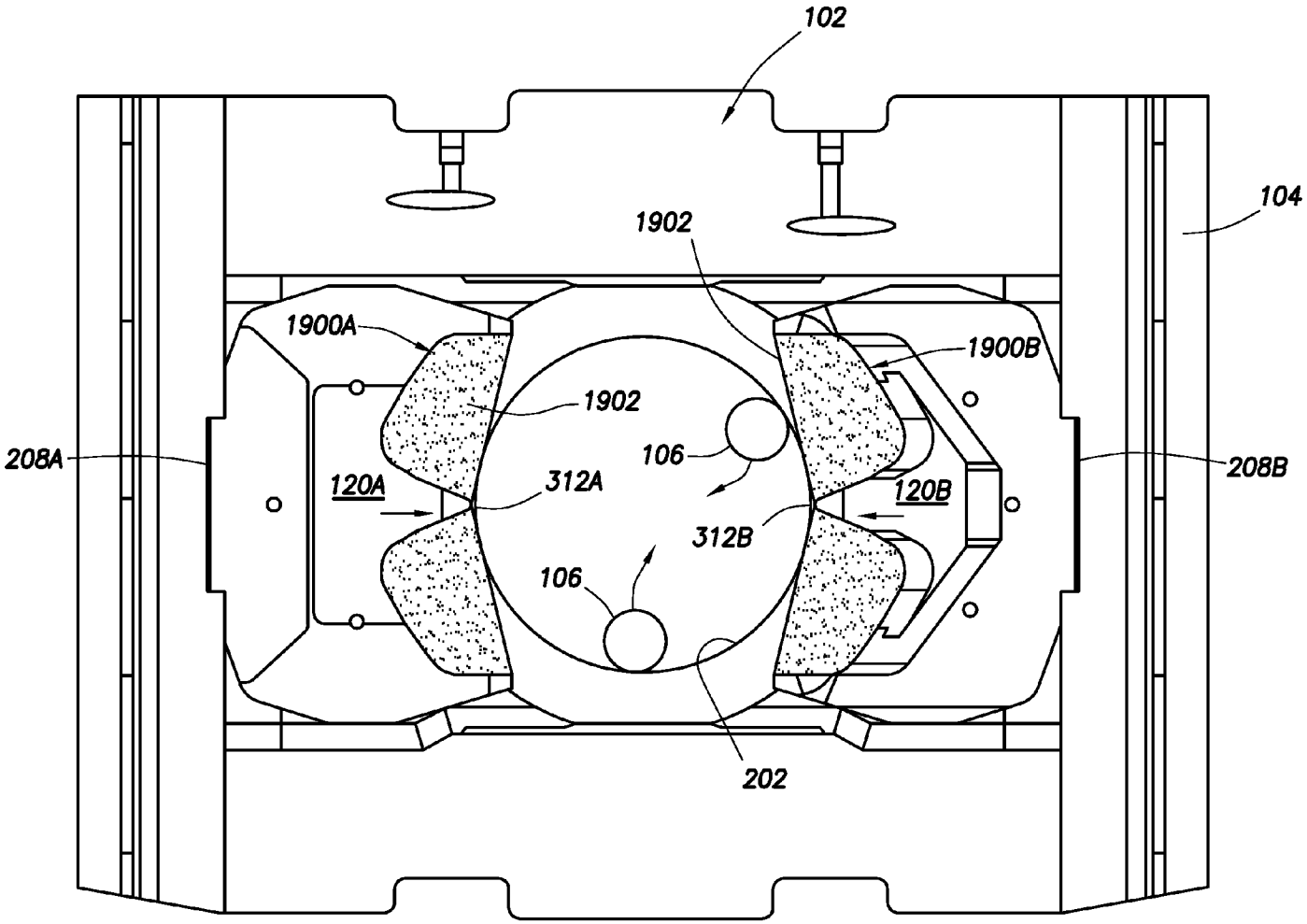

FIG. 19 is a top view of the blade assembly 102 having second alternate tubular centering systems 1900A,B. The second alternate tubular centering systems 1900A,B may have a brittle material 1902 mounted to portions of the ram blocks 208A and 208B and/or the blades 120A and 120B. The brittle material 1902 may be formed with the apexes 312A and 312B in order to center the tubular 106 as the ram blocks 208A and 208B move toward one another. The brittle material 1902 is schematically shown about blades 120A and 120B, but may be located above, below, and/or between the blades 120A and 120B. The brittle material 1902 may break prior to, or as the blades 120A and 120B are engaging the tubular 106 during the severing operation.

Figure 20:
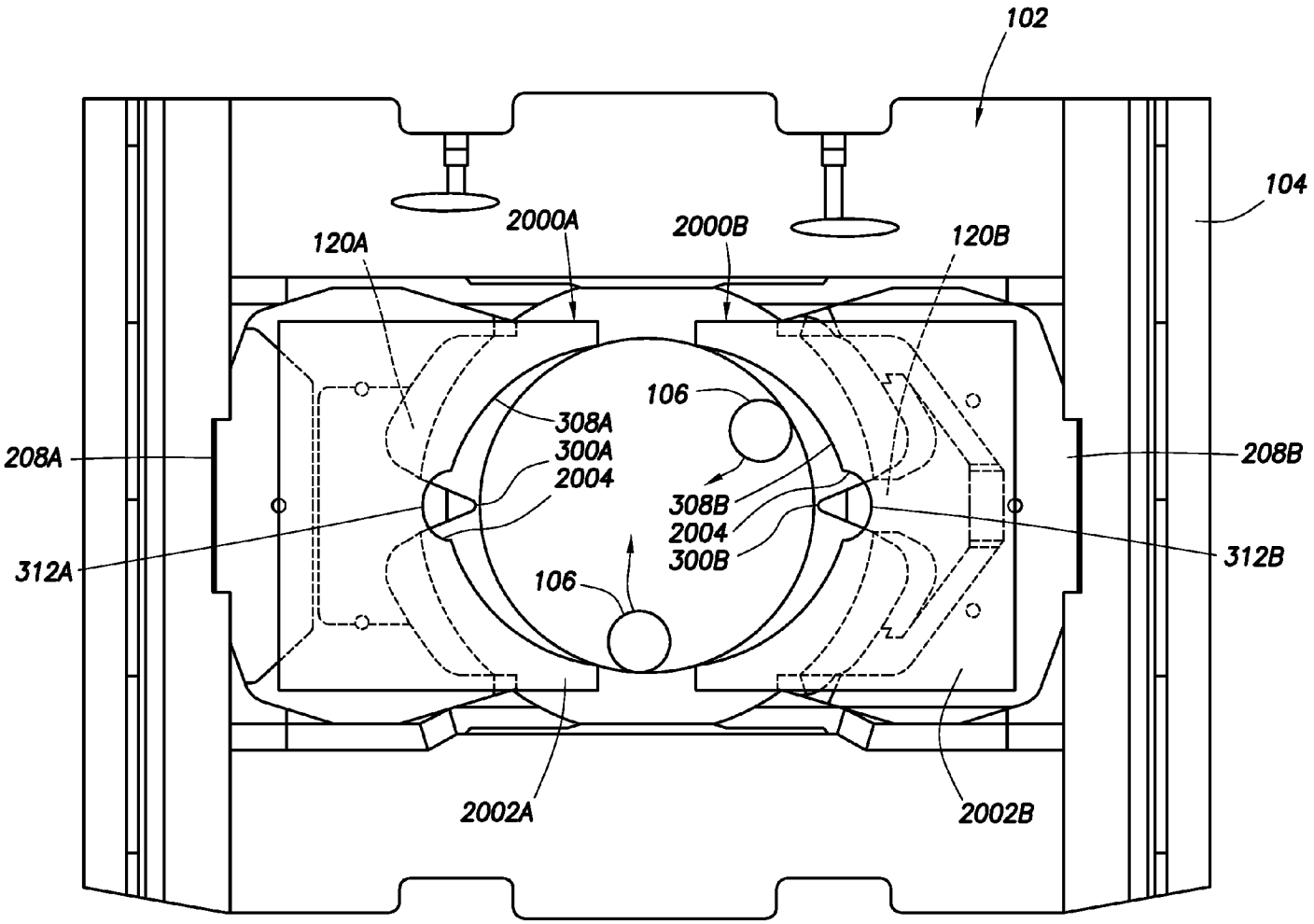

FIG. 20 is a top view of the blade assembly 102 having third alternate tubular centering systems 2000A,B. The third alternate tubular centering systems 2000A,B may have a centering plate 2002A,B mounted to each of the ram blocks 208A and 208B and/or the blades 120A and 120B. The centering plates 2002A,B are schematically shown about the ram blocks 208A and 208B, but may be positioned above, below and/or between components of the blade assembly 102 as desired. Each centering plate 2002A,B may have the guides 308A and 308B and a notch 2004. The notch 2004 may be located proximate the apexes 312A and 312B. The notch 2004 may allow the puncture points 300A and 300B to engage the tubular 106 prior to the apexes 312A and 312B engaging the tubular 106. The centering plate 2002 may have the biasing members 314 and/or the frangible member 316 (shown in FIG. 3) to allow the centering plate 2002 to move relative to the blades 120A and 120B once the tubular 106 is centered. As also demonstrated by FIG. 20, the blades 120A,B optionally may be positioned with both blades in an upright (or aligned) position, rather than with one blade inverted.

Figure 21:
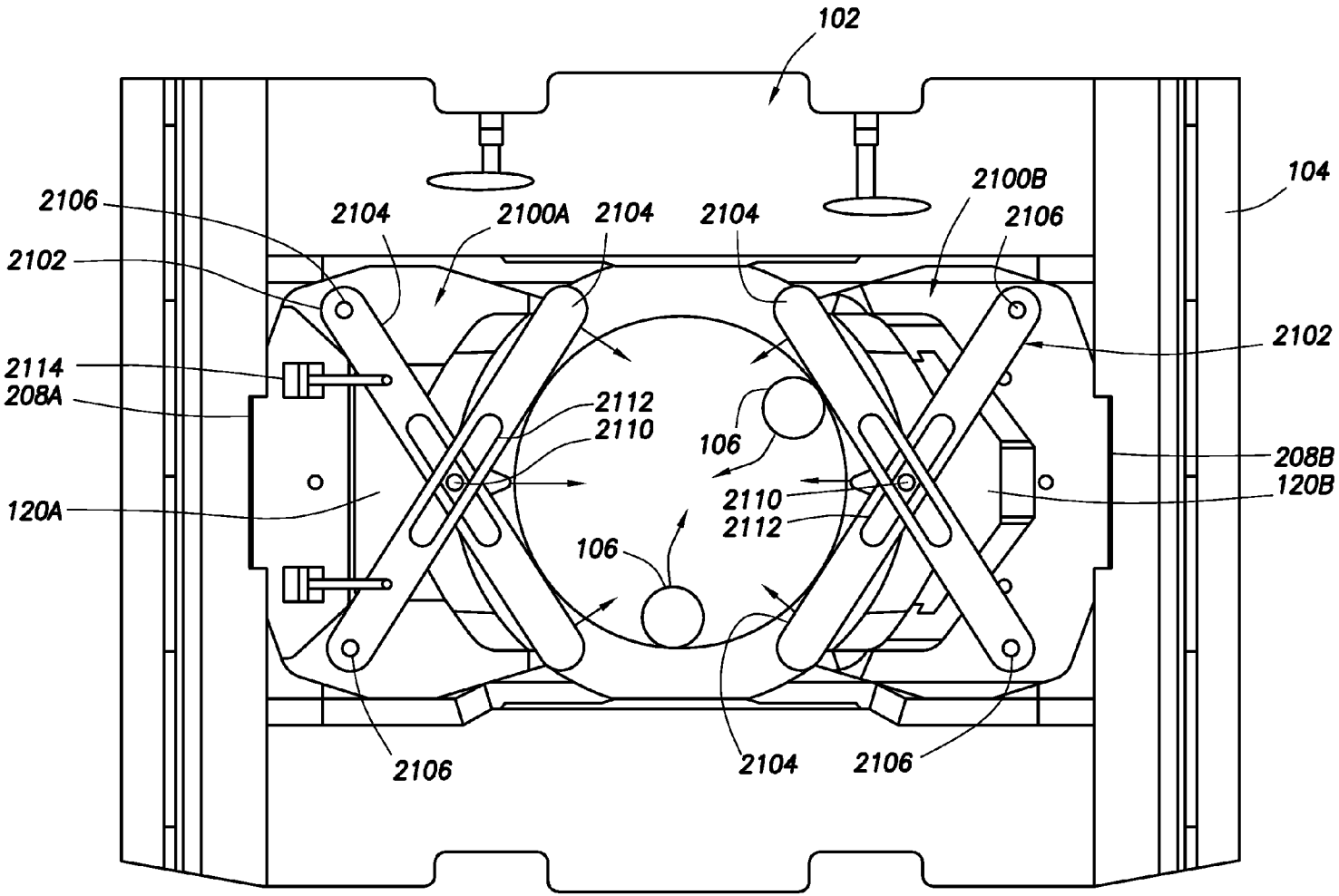

FIG. 21 is a top view of the blade assembly 102 having fourth alternate tubular centering systems 2100A,B. The fourth alternate tubular centering systems 2100A,B may have a scissor link 2102 mounted to the ram blocks 208A and 208B and/or the blades 120A and 120B. The scissor links 2102 may have two cross plates 2104 mounted to each of the ram blocks 208A and 208B or the blades 120A and 120B. The cross plates 2104 are schematically shown about blades 120A and 120B, but may be positioned above, below and/or between components of the blade assembly 102, and may be stacked into position as desired.

Each of the cross plates 2104 may pivotally couple to the ram blocks 208A and 208B at a pivot connection 2106. A scissor pin 2110 may couple each of the two cross plates 2104 together at one or more longitudinal slots 2112 in the cross plates 2104. One or more scissor actuators 2114 may be configured to push the cross plates 2104 out toward the tubular 106 in order to center the tubular 106 as the blades 120A and 120B approach the tubular 106. As shown with respect to the cross plate 2104 on blade 120A, a scissor actuator 2114 may be used for activation thereof. As shown with respect to the cross plate 2104 on blade 120B, the ram block 208B may be used for movement thereof. Other actuators may also be provided.

Figure 22:
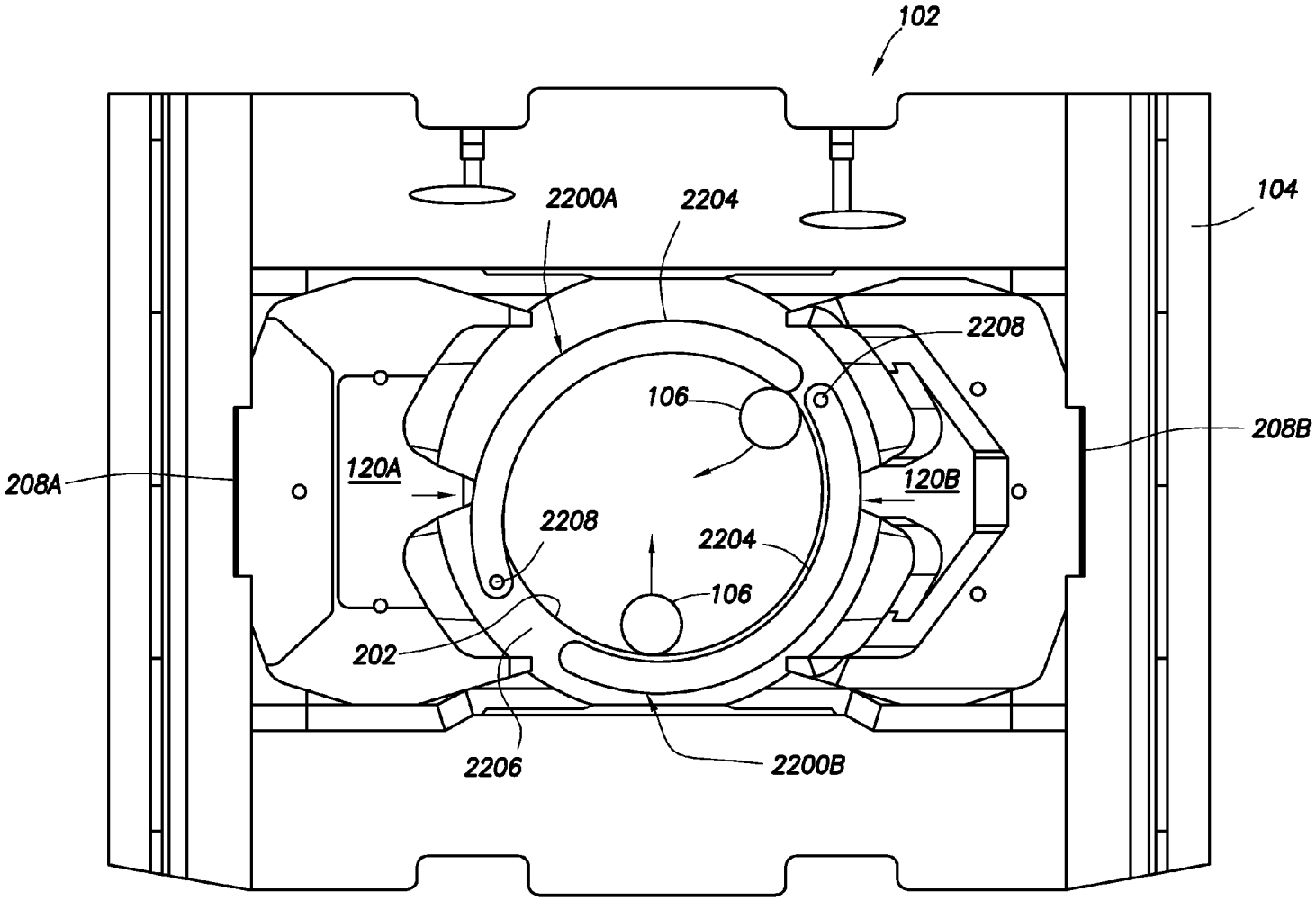

FIG. 22 is a top view of the blade assembly 102 having fifth alternate tubular centering systems 2200A,B. The fifth alternate tubular centering systems 2200A,B may have two pivoting arms 2204. The pivoting arms 2204 are schematically shown about the blades 120A and 120B, but may be positioned above, below and/or between components of the blade assembly 102 as desired. The pivoting arms 2204 may be configured to move into the hole 202 and guide the tubular 106 toward the center of the hole 202. The pivoting arms 2204 may be mounted in a skid plate 2206 of the BOP 104 at a skid plate pivot connection 2208. The pivoting arms 2204 may be actuated by an actuator (not shown) or be configured to move ahead of the blades 120A and 120B as the ram blocks 208A and 208B move. The pivoting arms 2204 may be curved in order to center the tubular 106 between the pivoting arms 2204 proximate the center of the hole 202.

Figure 23:
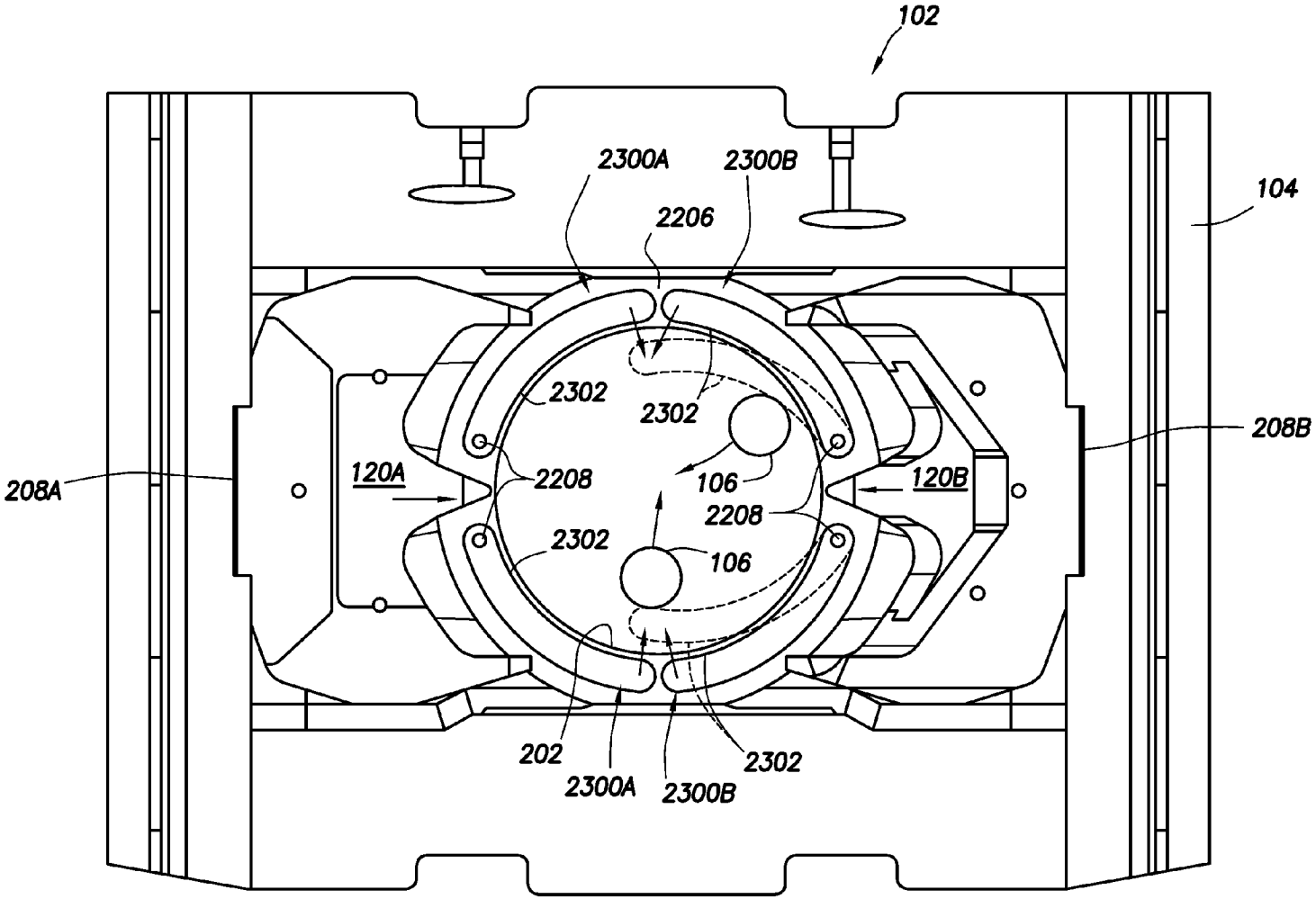

FIG. 23 is a top view of the blade assembly 102 having sixth alternate tubular centering systems 2300A,B. The sixth alternate tubular centering systems 2300A,B may have four pivoting arms 2302. The pivoting arms 2302 are schematically shown about the blades 120A and 120B, but may be positioned above, below and/or between components of the blade assembly 102 as desired. The pivoting arms 2302 may be configured to move into the hole 202 and guide the tubular 106 toward the center of the hole 202. The pivoting arms 2302 may be mounted in the skid plate 2206 of the BOP 104 at the skid plate pivot connection 2208.

The pivoting arms 2302 may be actuated by an actuator (not shown) or be configured to move ahead of the blades 120A and 120B as the ram blocks 208A and 208B move. The pivoting arms 2302 may be curved in order to center the tubular 106 between the pivoting arms 2302. Because there are four pivoting arms 2302, the tubular 106 may be centered in the hole 202 closer to one side of the hole 202. This may allow one of the blades 120A and/or 120B to engage the tubular 106 prior to the other blade.

Figure 24:
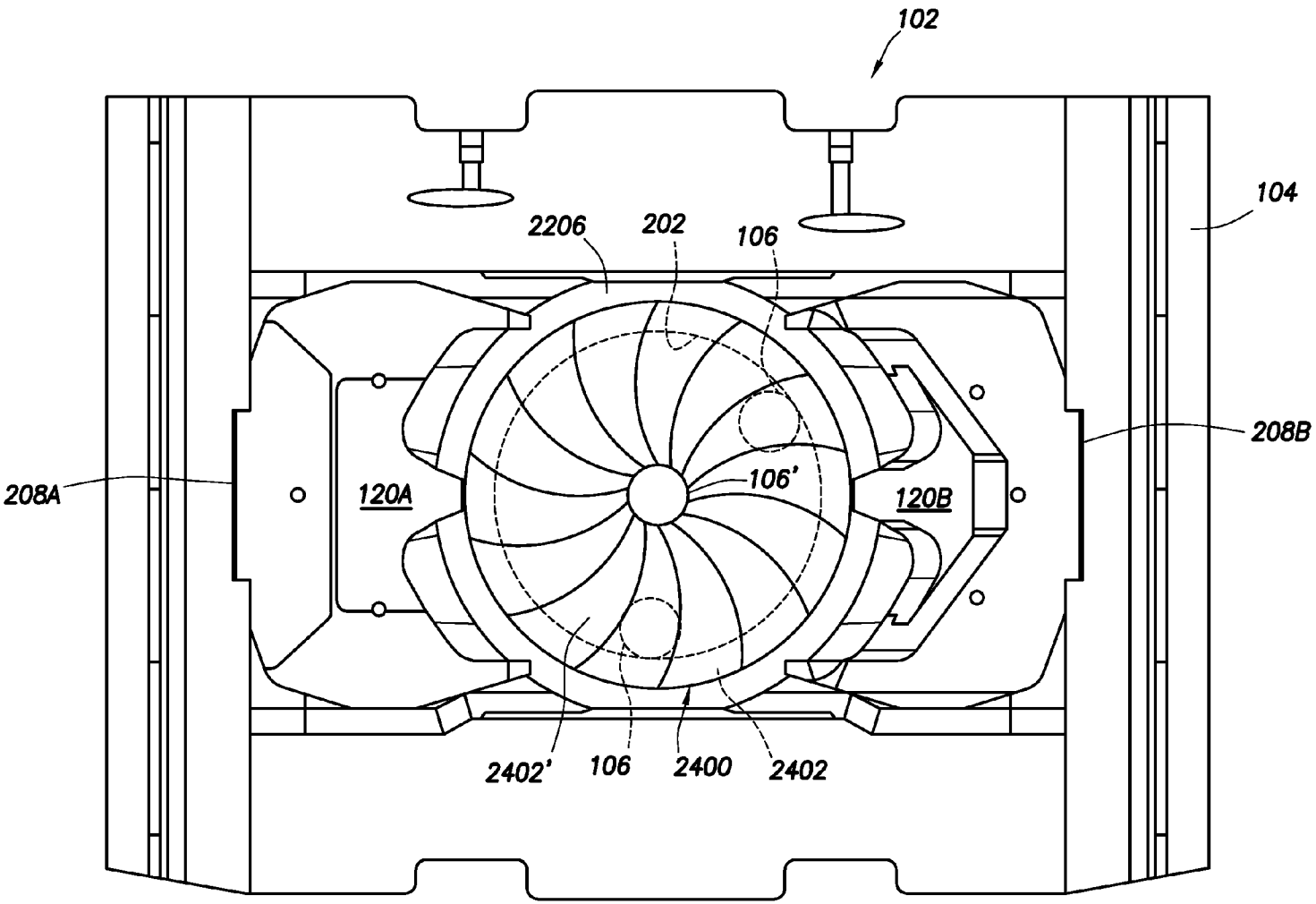

FIG. 24 is a top view of the blade assembly 102 having a seventh alternate tubular centering system 2400. The seventh alternate tubular centering system 2400 may have an airbag 2402 coupled to the skid plate 2206 of the BOP 104. The airbag 2402 may move between a deflated position shown in hidden line as 2402 and an inflated position 2402' as shown. Inflation may occur prior to the blades 120A and 120B engaging the tubular 106. As the airbag 2402 inflates, the airbag guides the tubular 106 from an original position (two possible original positions are shown in hidden line) to a centered position 106' toward the center of the hole 202. With the tubular 106' in the center of the hole 202, the severing operation may be performed.

The operation as depicted in FIGS. 7-24 shows a specific sequence of movement of the blades 120A,B and the various tubular centering systems. Variations in the order of movement may be provided. For example, the blades 120A,B and/or tubular centering systems may be advanced simultaneously or in various order. Additionally, the blades 120A,B and tubular centering systems are depicted as being identical components positioned opposite to each other for opposing interaction therebetween, but may be non-identical and at various positions relative to each other. The operation as described may be reversed to retract the blades 120A,B and/or tubular centering systems, and to repeat as desired.

Figure 25:
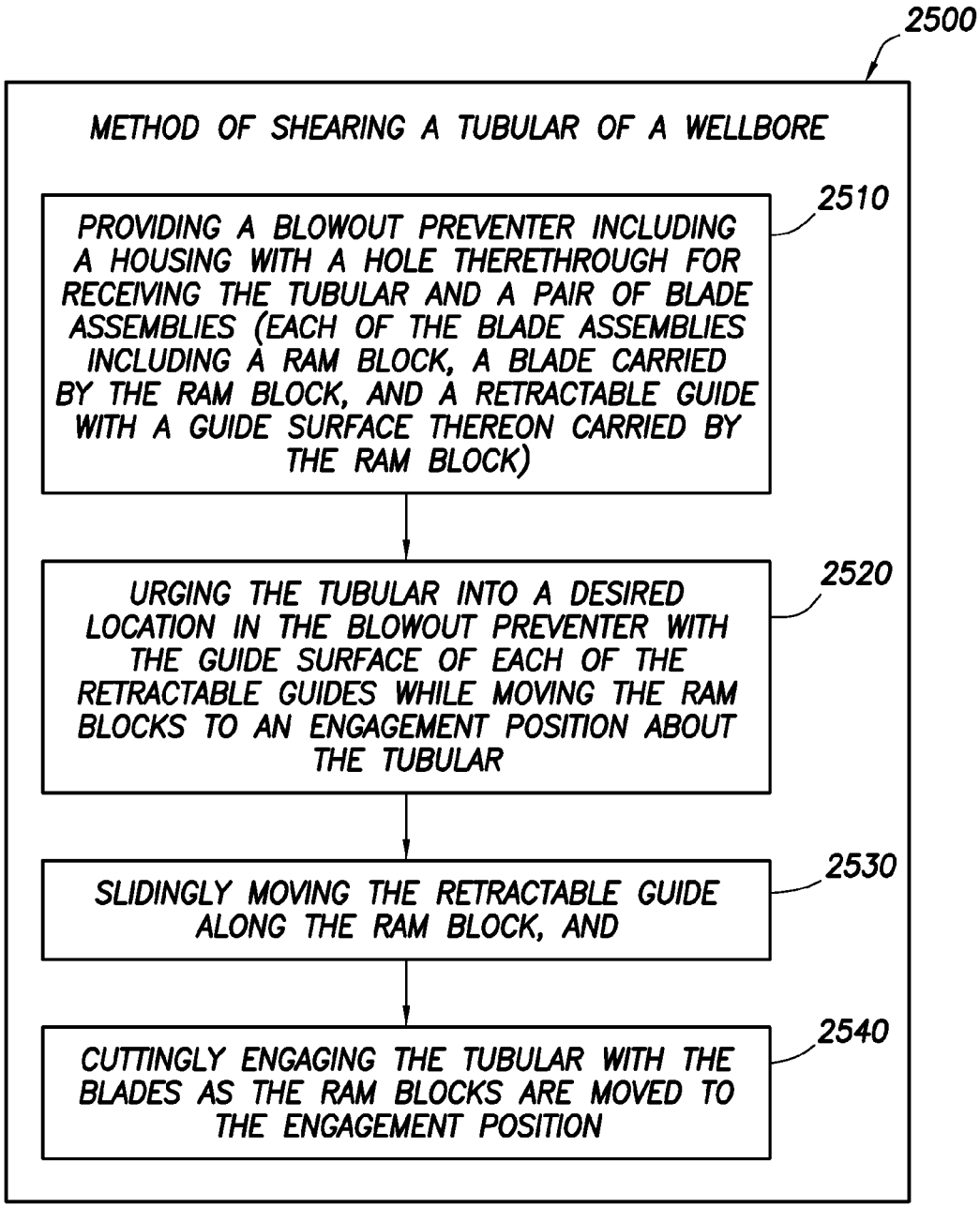
FIG. 25 is a flowchart depicting a method for shearing a tubular of a wellbore.

FIG. 25 depicts a method 2500 of shearing a tubular of a wellbore, such as the wellbore 108 of FIG. 1. The method involves providing 2510 a BOP including a housing with a hole therethrough for receiving the tubular and a pair of blade assemblies. Each of the pair of blade assemblies includes a ram block, a blade carried by the ram block, and a retractable guide with a guide surface thereon carried by the ram block. The method further involves urging 2520 the tubular into a desired location in the BOP with the guide surface of each of the retractable guides while moving the ram blocks to an engagement position about the tubular, slidingly moving 2530 the retractable guide along the ram block, and 2540 cuttingly engaging the tubular with the blades as the ram blocks are moved to the engagement position. Additional steps may also be performed, and the steps may be repeated as desired.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, various combinations of blades (e.g., identical or non-identical) and tubular centering systems may be provided in various positions (e.g, aligned, inverted) for performing centering and/or severing operations.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A blade assembly of a blowout preventer for shearing a tubular of a wellbore penetrating a subterranean formation, the blowout preventer having a housing with a hole therethrough to receive the tubular, the blade assembly comprising:

a ram block movable between a non-engagement position and an engagement position about the tubular;

a blade carried by the ram block to cuttingly engage the tubular; and a retractable guide carried by the ram block and slidably movable therealong, the retractable guide having a guide surface to urge the tubular into a desired location in the blowout preventer as the ram block moves to the engagement position;

wherein the guide surface is concave with an apex along a central portion thereof and wherein the blade has a puncture point extendable beyond the apex.

2. The blade assembly of claim 1, wherein the retractable guide has a notch extending through the apex, the puncture point of the blade extending beyond the notch to pierce the tubular.

3. The blade assembly of claim 1, further comprising a lip to selectively release the retractable guide to move between a guide position to engage the tubular and a cutting position retracted a distance behind an engagement end of the blade.

4. A blowout preventer for shearing a tubular of a wellbore penetrating a subterranean formation, the blowout preventer comprising:

a housing with a hole therethrough to receive the tubular; and a pair of blade assemblies, each of the pair of blade assemblies comprising:

a ram block movable between a non-engagement position and an engagement position about the tubular;

a blade carried by the ram block to cuttingly engage the tubular; and a retractable guide carried by the ram block and slidably movable therealong, the retractable guide having a guide surface to urge the tubular into a desired location in the blowout preventer as the ram block moves to the engagement position;

wherein the guide surface is concave with an apex along a central portion thereof and wherein the blade has a puncture point extendable beyond the apex.

5. The blowout preventer of claim 4, wherein the retractable guide of each of the pair of blade assemblies is the same.

6. The blowout preventer of claim 4, wherein the retractable guide of each of the pair of blade assemblies is different.

7. The blowout preventer of claim 4, wherein the blade of each of the pair of blade assemblies is the same.

8. The blowout preventer of claim 4, wherein the blade of each of the pair of blade assemblies is different.

9. The blowout preventer of claim 4, further comprising at least one actuator to actuate the ram block of each of the blade assemblies.

10. A method of shearing a tubular of a wellbore penetrating a subterranean formation, the method comprising:

providing a blowout preventer, comprising:

a housing with a hole therethrough to receive the tubular; and a pair of blade assemblies, each of the pair of blade assemblies comprising:

a ram block;

a blade carried by the ram block; and a retractable guide with a guide surface thereon carried by the ram block;

urging the tubular into a desired location in the blowout preventer with the guide surface of each of the retractable guides while moving each of the ram blocks from a non-engagement position to an engagement position about the tubular;

slidably moving the retractable guide along the ram block; and cuttingly engaging the tubular with the pair of blades as the ram blocks are moved to the engagement position; and selectively releasing the retractable guide to move between a guide position to engage the tubular to a cutting position a distance behind an engagement end of the blade.

11. The method of claim 10, further comprises biasing the retractable guide toward the guide position.

12. The method of claim 10, wherein the urging comprises urging the tubular along a curved surface of the retractable guide toward an apex along a center thereof.

13. The method of claim 12, wherein the urging further comprises advancing the tubular to a central portion of the blowout preventer with the retractable guide.

14. The method of claim 10, wherein each of the blade assemblies are positionable on opposite sides of the tubular.

15. A blade assembly of a blowout preventer for shearing a tubular of a wellbore penetrating a subterranean formation, the blowout preventer having a housing with a hole therethrough to receive the tubular, the blade assembly comprising:

a ram block movable between a non-engagement position and an engagement position about the tubular;

a blade carried by the ram block to cuttingly engage the tubular;

a retractable guide carried by the ram block and slidably movable therealong, the retractable guide having a guide surface to urge the tubular into a desired location in the blowout preventer as the ram block moves to the engagement position; and a lip to selectively release the retractable guide to move between a guide position to engage the tubular and a cutting position retracted a distance behind an engagement end of the blade.

* * * * *